US011458052B2

(12) United States Patent
Lachenbruch et al.

(10) Patent No.: US 11,458,052 B2
(45) Date of Patent: Oct. 4, 2022

(54) SKIN INJURY RESISTANT OCCUPANT SUPPORT STRUCTURES AND METHODS FOR RESISTING SKIN INJURIES

(71) Applicant: Hill-Rom Services, Inc., Batesville, IN (US)

(72) Inventors: Charles A. Lachenbruch, Batesville, IN (US); Neal Wiggermann, Batesville, IN (US); Darrell L. Borgman, Batesville, IN (US); Eric R. Meyer, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 173 days.

(21) Appl. No.: 16/454,445

(22) Filed: Jun. 27, 2019

(65) Prior Publication Data

US 2020/0038269 A1 Feb. 6, 2020

Related U.S. Application Data

(60) Provisional application No. 62/713,210, filed on Aug. 1, 2018.

(51) Int. Cl.
*A61G 7/015* (2006.01)
*A61G 7/018* (2006.01)
(Continued)

(52) U.S. Cl.
CPC ..... *A61G 7/015* (2013.01); *A61G 7/018* (2013.01); *A61G 7/057* (2013.01); *A61G 7/012* (2013.01);
(Continued)

(58) Field of Classification Search
CPC ..... A61G 7/012; A61G 7/015; A61G 7/018; A61G 7/05; A61G 7/0501; A61G 7/057;
(Continued)

(56) References Cited

U.S. PATENT DOCUMENTS 4,097,940 A 4/1978 Tekulve et al.
4,944,060 A 7/1990 Peery et al.
(Continued)

FOREIGN PATENT DOCUMENTS

EP 0722683 A1 7/1996
WO 1998036665 8/1998
(Continued)

OTHER PUBLICATIONS

European Search Report for EP Application 19188937.7; dated Dec. 5, 2019; Place of search—The Hague; Date of completion of the search—Nov. 22, 2019.
(Continued)

*Primary Examiner* — David R Hare
*Assistant Examiner* — Alexis Felix Lopez
(74) *Attorney, Agent, or Firm* — Barnes & Thornburg LLP

(57) ABSTRACT

An occupant support structure for supporting an occupant includes an orientation adjustable torso section, a lower body section, and a control system. The lower body section includes a heel region subsection which supports the heel region of an occupant of the occupant support. The control system is adapted to A) cause the heel region subsection to temporarily substantially disengage from the heel region of the occupant in response to a change of angular orientation of the torso section which begins at a time $t_0$, and B) cause the heel region subsection to subsequently re-engage with the heel region of the occupant, the re-engagement occurring at a time $t_B$ which is later than $t_0$.

21 Claims, 31 Drawing Sheets

(51) Int. Cl.
*A61G 7/057* (2006.01)
*A61G 7/012* (2006.01)
*A61G 7/05* (2006.01)

(52) U.S. Cl.
CPC ..... *A61G 7/0501* (2013.01); *A61G 7/05769* (2013.01); *A61G 7/05776* (2013.01)

(58) Field of Classification Search
CPC ..... A61G 7/05715; A61G 7/0573; A61G 7/05769; A61G 7/05776; A61G 7/065; A61G 7/07; A61G 7/0755; A61G 2203/74
See application file for complete search history.

(56) References Cited

U.S. PATENT DOCUMENTS 5,526,543 A 6/1996 DiMatteo
6,012,186 A 1/2000 Soltani et al.
6,351,863 B1 * 3/2002 Meyer ..... A61G 7/05769 5/713
6,370,716 B1 4/2002 Wilkinson
6,634,045 B1 10/2003 DuDonis et al.
7,330,127 B2 * 2/2008 Price ..... A61B 5/0205 340/666
7,657,956 B2 2/2010 Stacy et al.
7,685,664 B2 * 3/2010 Stolpmann ..... A47C 27/144 5/731
7,909,787 B2 3/2011 Ravikumar
7,975,335 B2 * 7/2011 O'Keefe ..... A61G 7/05784 5/616
RE43,155 E * 2/2012 Allen ..... A61G 7/008 5/618
8,146,187 B2 * 4/2012 Lachenbruch ..... A61G 7/015 5/612
8,365,330 B2 2/2013 Lachenbruch
8,756,732 B2 6/2014 Lachenbruch
9,132,051 B2 * 9/2015 Heil ..... A61G 7/0514
9,204,732 B2 12/2015 Wyatt et al.
9,259,098 B2 * 2/2016 Williams ..... A47C 27/088
9,358,168 B2 6/2016 Williamson et al.
9,707,141 B2 7/2017 Bobey et al.
9,707,142 B2 7/2017 Lachenbruch et al.
9,867,748 B2 * 1/2018 Takeda ..... A61G 7/05776
9,901,491 B2 2/2018 Squitieri
2004/0031103 A1 2/2004 Wyatt et al.
2008/0040861 A1 2/2008 Ootayopas
2011/0263950 A1 * 10/2011 Larson ..... A61B 5/026 600/301
2012/0304385 A1 * 12/2012 Ishibashi ..... A61G 7/015 5/613
2015/0164677 A1 * 6/2015 Squitieri ..... A61F 5/34 128/892
2017/0127845 A1 5/2017 Bhat et al.
2019/0174931 A1 * 6/2019 Ohno ..... A61G 7/05769

FOREIGN PATENT DOCUMENTS

WO 2016016602 A1 2/2016
WO 2018035604 A1 3/2018

OTHER PUBLICATIONS

Computer Modeling Studies to Assess Whether a Prophylactic Dressing Reduces the Risk for Deep Tissue Injury in the Heels of Supine Patients with Diabetes; Ayelet Levy, MSc; Amit Gefen, PhD; vol. 62—Issue 4—Apr. 2016.
Effects of ambient conditions on the risk of pressure injuries in bedridden patients—multi-physics modelling of microclimate; Tal Zeevi; Ayelet Levy; Neima Brauner; Amit Gefen; Int. Wound J. 2017; 1-15.
U.S. Appl. No. 16/285,608, filed Feb. 26, 2019; Patient Support Surface Control, End of Life Indication, and X-Ray Cassette Sleeve. Drawings as filed for U.S. Appl. No. 16/285,608.

* cited by examiner

SKIN INJURY RESISTANT OCCUPANT SUPPORT STRUCTURES AND METHODS FOR RESISTING SKIN INJURIES

CROSS REFERENCE TO RELATED APPLICATIONS

This application claims priority to U.S. Provisional Application 62/713,210 entitled "Skin Injury Resistant Occupant Support Structures and Methods for Resisting Skin Injuries" filed on Aug. 1, 2018, the contents of which are incorporated herein by reference.

TECHNICAL FIELD

The subject matter described herein relates to occupant support structures having features for resisting skin injuries to an occupant of the support structure, and associated methods for resisting skin injuries.

BACKGROUND

Many beds of the type used in hospitals and other health care settings have a longitudinally segmented frame. For example the frame may have a torso segment, a seat segment, a thigh segment, and a calf/foot segment corresponding approximately to the torso, buttocks, thighs, and calves/feet of a patient occupying the bed. At least some of the segments are rotatable about respective laterally extending axes so that the profile of the bed can be adjusted. A mattress resides on the frame. The mattress flexes in response to changes in the angular orientation of the rotatable frame segments so that the mattress profile mimics the frame profile.

When the frame torso segment rotates further away from a horizontal orientation, the rotation tends to push the patient longitudinally toward the foot end of the bed. The footward migration of a supine patient can drive his heels into the portion of the mattress underneath the his feet, with the attendant effect of stretching the skin in the vicinity of his heels. Depending on the patient's posture on the bed (e.g. if the patient is lying on his side), a similar skin stretch can occur in the vicinity of the patient's medial malleolus or lateral malleolus. Once the torso segment rotation is complete, the stretched skin remains in its stretched state, which makes the skin more vulnerable to the development of pressure ulcers or other skin injuries. Therefore, it is desirable to not leave the skin in its stretched state for an extended interval of time.

A patient who is reasonably capable of moving around in the bed may move enough that his feet temporarily break contact with the mattress, allowing the stretched skin to relax back to its unstretched, injury resistant state. For a patient who is not capable of enough movement, a nurse can temporarily lift the patient's feet off the mattress so that the stretched skin can relax. However there is no guarantee that the patient will move enough, or that a nurse will act to relieve the skin stretch. Therefore, it is desirable to provide patient support structures and methods that will relieve the skin stretch without relying on the possibility of patient movement or nurse intervention.

SUMMARY an occupant support structure for supporting an occupant includes an orientation adjustable torso section, and a lower body section, including a heel region subsection, which supports the heel region of an occupant of the occupant support. The occupant support structure also includes a control system. The control system is adapted to:

A) cause the heel region subsection to temporarily substantially disengage from the heel region of the occupant in response to a change of angular orientation of the torso section which begins at a time $t_0$; and B) cause the heel region subsection to subsequently re-engage with the heel region of the occupant, the re-engagement occurring at a time $t_B$ which is later than $t_0$

BRIEF DESCRIPTION OF THE DRAWINGS

The foregoing and other features of the various embodiments of the occupant support structure and method described herein will become more apparent from the following detailed description and the accompanying drawings in which.

DETAILED DESCRIPTION

Figure 1:
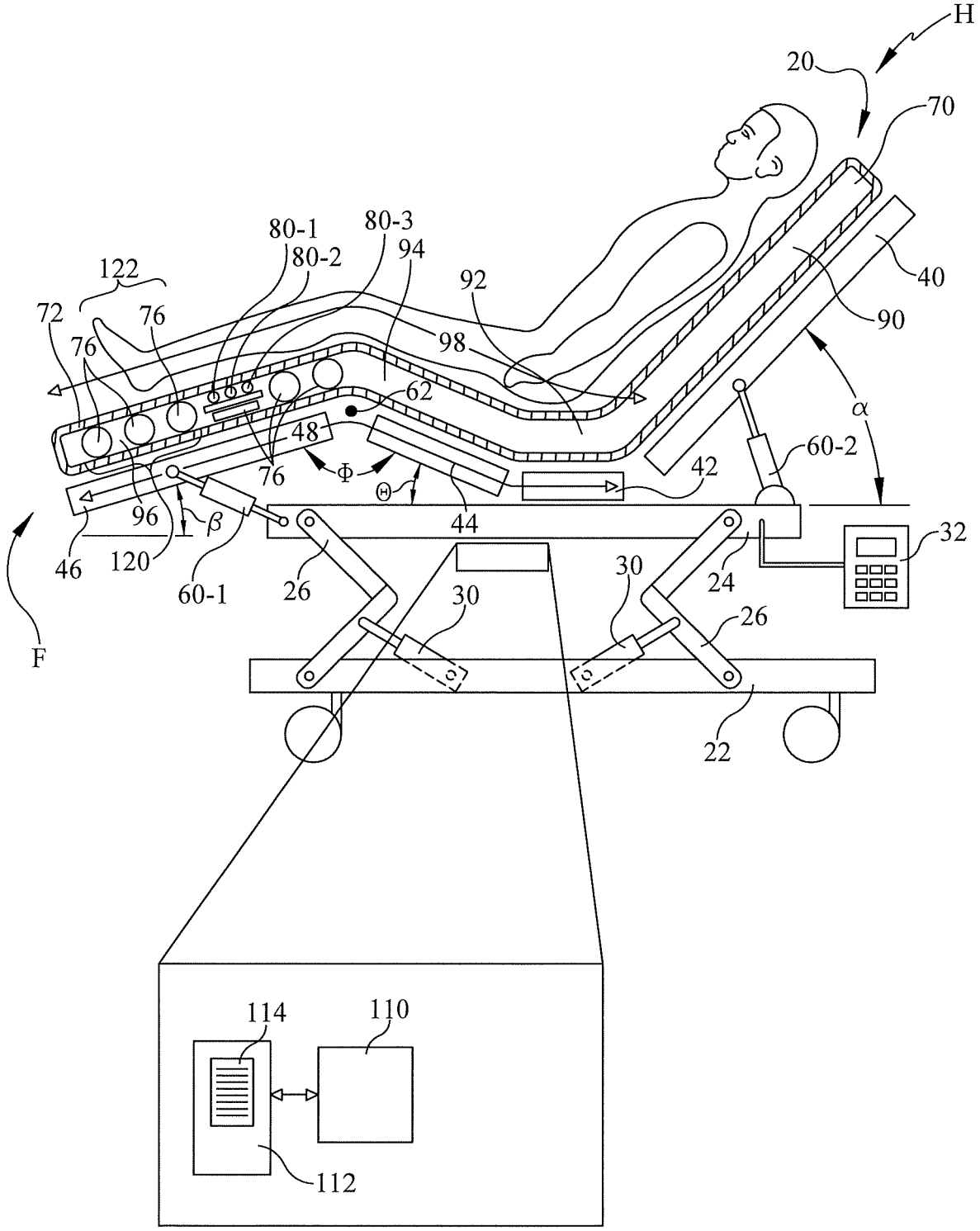
FIG. 1 is a schematic, left side elevation view of a hospital bed with a patient lying on a mattress component thereof in a supine posture, the mattress having support bladders and an array of multiple heel relief bladders pressurized to provide support to the patient, the view also showing a schematic representation of components of a control system including a processor and machine readable instructions which are executable by the processor.

The present invention may comprise one or more of the features recited in the appended claims and/or one or more of the following features or combinations thereof.

In this specification and drawings, features similar to or the same as features already described may be identified by reference characters or numerals which are the same as or similar to those previously used. Similar elements may be identified by a common reference character or numeral, with suffixes being used to refer to specific occurrences of the element. Examples given in this application are prophetic examples.

Figure 2:
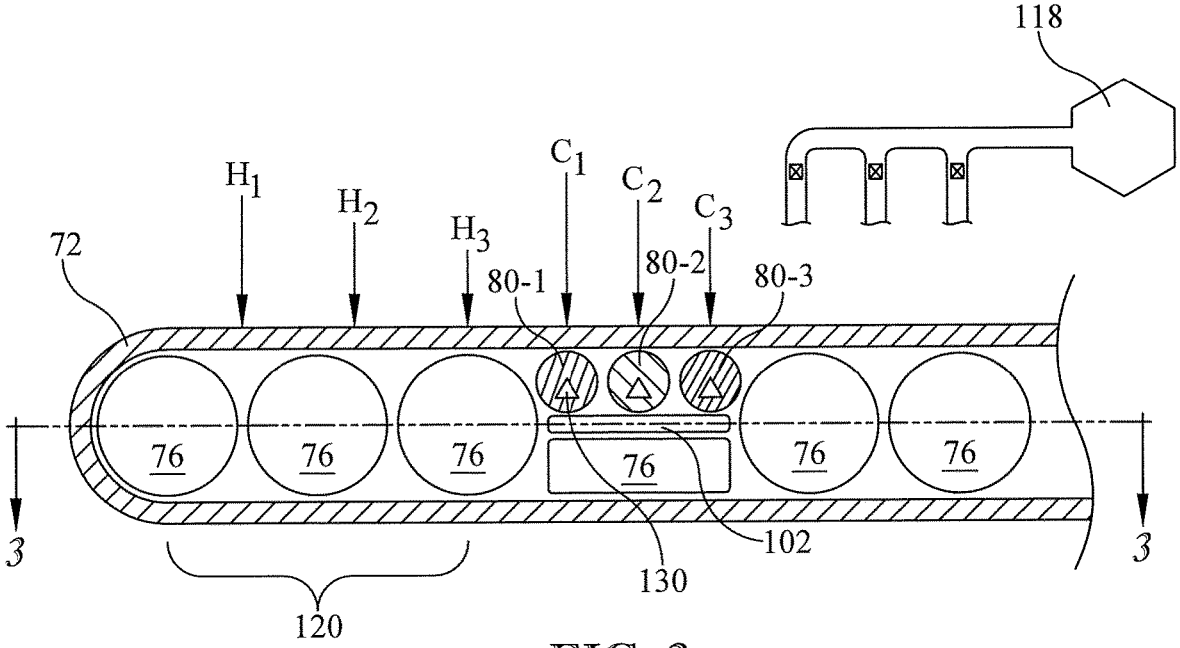
FIG. 2 is an enlarged view of a portion of the mattress of FIG. 1.
Figure 3:
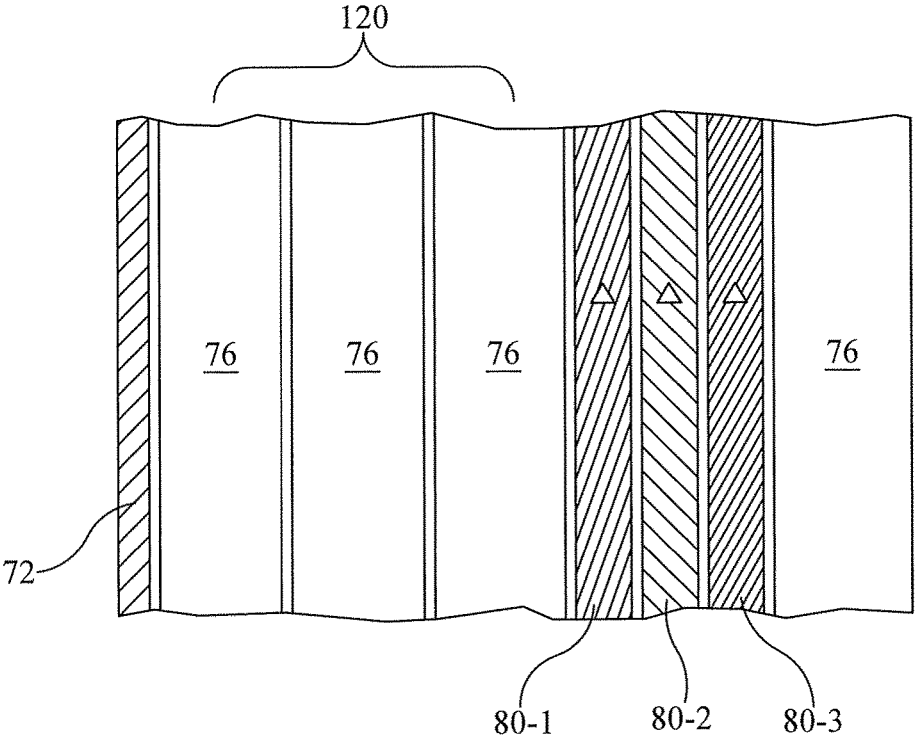
FIG. 3 is a cross sectional view along 3-3 of FIG. 2.

Referring to FIGS. 1-3 a hospital bed 20 extends longitudinally from a head end H to a foot end F and laterally from a left side (visible in the plane of the illustration) to a right side. The bed includes a base frame 22 and an elevatable frame 24 supported from and connected to the base frame by, for example, rotatable links 26. Actuators 30 drive the links to change the elevation of the elevatable frame relative to the base frame. A user directs operation of actuators 30 by way of a user interface such as a keypad 32.

The elevatable frame includes a deck comprising a torso or upper body segment 40 corresponding approximately to the torso of an occupant or patient, a seat segment 42 corresponding approximately to the occupant's buttocks, a thigh segment 44 corresponding approximately to the occupant's thighs, and a calf segment 46 corresponding approximately to the occupant's calves and feet. The seat, thigh and calf segments define a lower body segment 48. Deck segment actuators 60 are operable to rotate the torso, thigh, and calf segments thereby adjusting orientation angles $\alpha$, $\theta$, and $\beta$ of those segments. The thigh and calf segments are rotatably joined to each other at a joint or hinge 62 so that angles $\beta$, $\theta$, and $\phi$, are interdependent. Taken collectively, the angular orientations of the torso, seat, thigh and calf deck segments define the profile of the deck. Deck segment rotations away from horizontal (and the accompanying changes of the orientation angle) are considered to be positive. Deck segment rotations toward horizontal (and the accompanying changes of the orientation angle) are considered to be negative. As used herein the phrase "away from horizontal" means an increase in angle $\alpha$ even if $\alpha$ is not initially zero. Similarly, "toward horizontal" means a decrease in angle $\alpha$ even if $\alpha$ is not zero after the change is complete. A user directs operation of deck segment actuators 60 by way of a user interface such as keypad 32.

The bed also includes a mattress 70 supported on the deck. The illustrated mattress includes a ticking 72 which encloses one or more support components. Typical support components include foam blocks, bladders pressurized with a gas (typically air), and combinations of foam and bladders. Support bladders may be factory inflated and sealed or may be actively inflatable and deflatable during use to carry out therapy, prevent detrimental changes in the patient's condition, or enhance patient comfort. (In this specification, the term "inflatable", when applied to a bladder, means inflatable and deflatable unless stated otherwise.)

Figure 4:
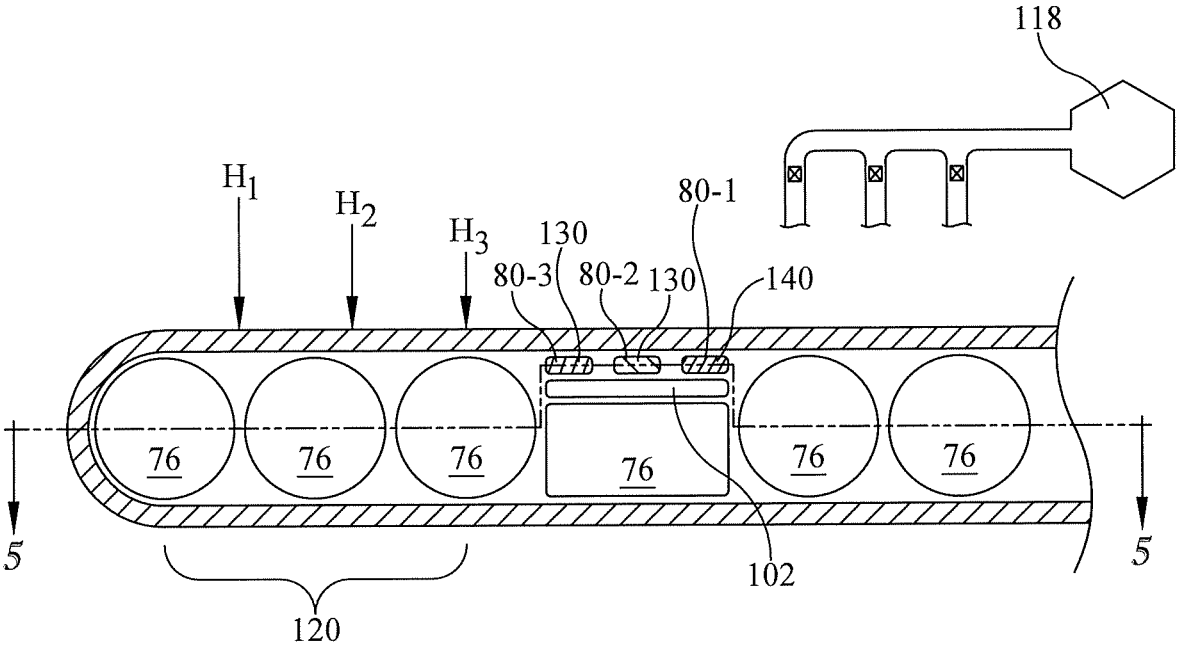
FIGS. 4-5 are views similar to those of FIGS. 2-3 showing heel relief bladders not sufficiently pressurized to provide support to the patient.

The support component of the mattress illustrated in FIGS. 1-3 includes a set of longitudinally distributed main support bladders 76 and one or more heel relief bladders 80. In FIGS. 1-3 the illustrated main bladders and heel relief bladders are all appropriately pressurized to provide sustained support to the occupant. Sustained support is long duration support as distinct from transient support which is provided temporarily by the heel relief bladders to counteract stretching of the occupant's skin, as described more thoroughly below. In an alternative embodiment seen in FIG. 4, only the main bladders are pressurized to provide sustained support in the heel region subsection 120. (The heel region subsection is described in more depth below.) The heel relief bladders are unpressurized or are only slightly pressurized so that they play no meaningful role in sustained support of the occupant. Instead, the heel relief bladders are essentially collapsed between the mattress ticking and whatever component resides underneath the heel relief bladders.

The mattress can be thought of as having torso, seat, thigh, and calf/foot sections 90, 92, 94, 96 corresponding to the torso, seat, thigh and calf/foot segments of the deck. The seat, thigh, and calf sections define a lower body section 98. The mattress is flexible enough to conform to the profile of the deck as governed by the deck segment actuators 60. That is, the mattress flexes in response to a change of orientation of one or more deck segments. The angles $\alpha$, $\beta$, $\theta$, and $\phi$ used to indicate the orientations of the deck segments are therefore also used to describe the orientations of the mattress sections. Accordingly, mattress sections 90, 92, 94, 96 are considered to be orientation adjustable even though their orientations are effected by the orientation of the deck segments rather than being governed directly by actuators. In the examples given in this specification, references to a change in the orientation of one of the mattress sections should be understood to be a change in the orientation of the mattress section as driven by the corresponding deck segment. However, notwithstanding the foregoing, the concepts described herein are applicable to beds having mattress sections that are orientation adjustable independently of orientation adjustment of a deck segment or segments. Such a mattress is described in U.S. Pat. No. 8,146,187 entitled "Mattress and Mattress Replacement System with and [sic] Intrinsic Contour Feature", the contents of which are incorporated herein by reference.

This specification uses the phrase "occupant support structure" to refer to a mattress or mattress-like article standing alone, a frame standing alone, or the combinations of a mattress or mattress like article and a frame. The usage intended will be evident from context and by reference to the accompanying drawings.

As seen best in FIG. 1 and the inset thereto, the occupant support structure also includes a control system. In one example the control system includes a processor 110, a memory 112, and a set of machine readable instructions 114 stored in the memory. The processor receives directives from a user, for example by way of keypad 32. The processor executes appropriate machine readable instructions from the instruction set and issues commands required to carry out the user's directive. References in this specification to the operation, functioning or actions of the processor mean the actions undertaken by the processor in response to instructions from instruction set 114 that are appropriate to the directive from the user. For example a user may press a keypad button to direct an increase in the orientation angle $\alpha$ of torso frame segment 40. In response, the processor executes instructions from instruction set 114 which cause actuator 60-2 to operate in a way that increases torso angle $\alpha$.

The occupant support system also includes an air pump or blower 118 and associated plumbing and valves for pressurizing at least an array of heel relief bladders 80. The heel relief bladders can also be partially or completely depressurized by operating the pump in reverse to apply suction to the bladders or by simply venting the bladders to the atmosphere.

Figure 6:
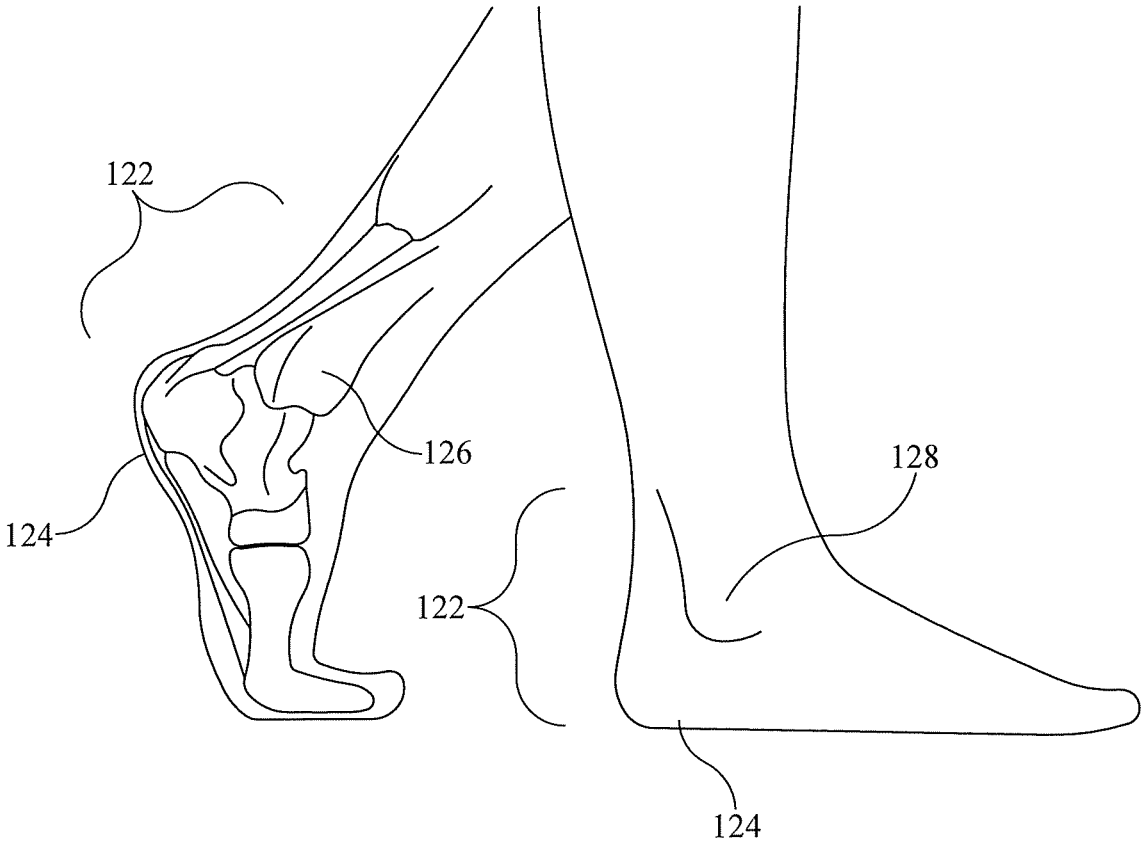
FIG. 6 is a view showing anatomical features of human feet and heel regions thereof.

Mattress lower body section 98 includes a heel region subsection 120. When an occupant is correctly positioned on the occupant support structure, the occupant's heel region 122 is longitudinally aligned with mattress heel region subsection 120 so that the heel region subsection supports at least part of the occupant's heel region. Heel region subset 120 is longitudinally long enough to accommodate a range of patients from short to tall. Referring to FIG. 6, the occupant's heel region 122 extends from the heel 124 itself to just past the ankle or, more technically, just beyond the medial malleolus 126 on the medial side of the foot and just beyond the lateral malleolus 128 on the lateral side of the foot. Inclusion of the medial malleolus and the lateral malleolus in the definition of the heel region reflects the fact that both of those anatomical features are prominences which could be subject to skin stretching and shear similar to that described above for the heel. This may be particularly true if the patient is not supine or if his leg is bent at the knee when the orientation of the torso section undergoes a change.

Figure 5:
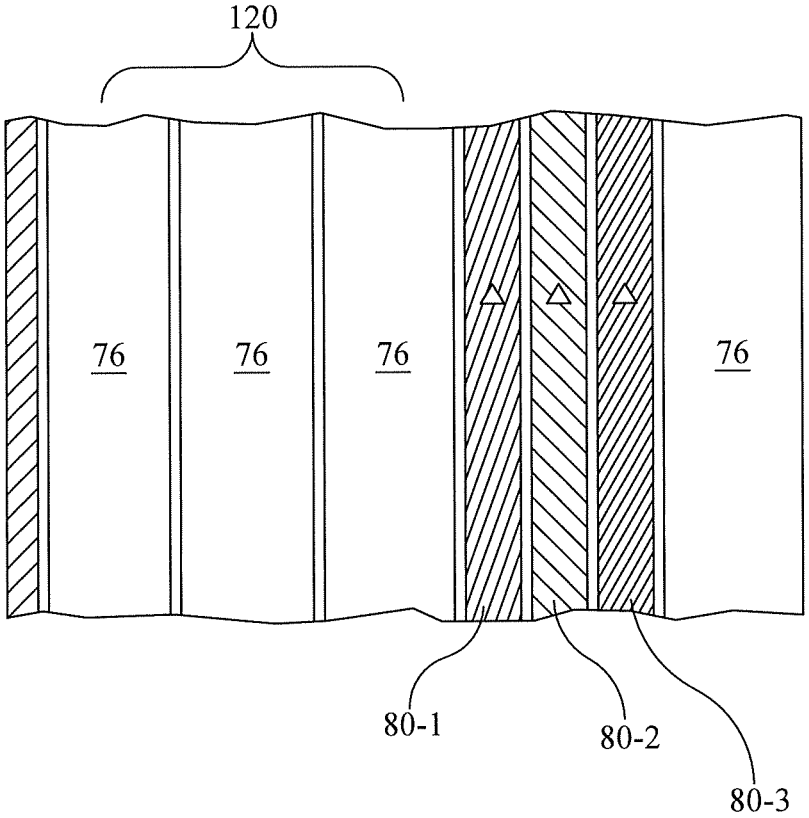
Figure 7:
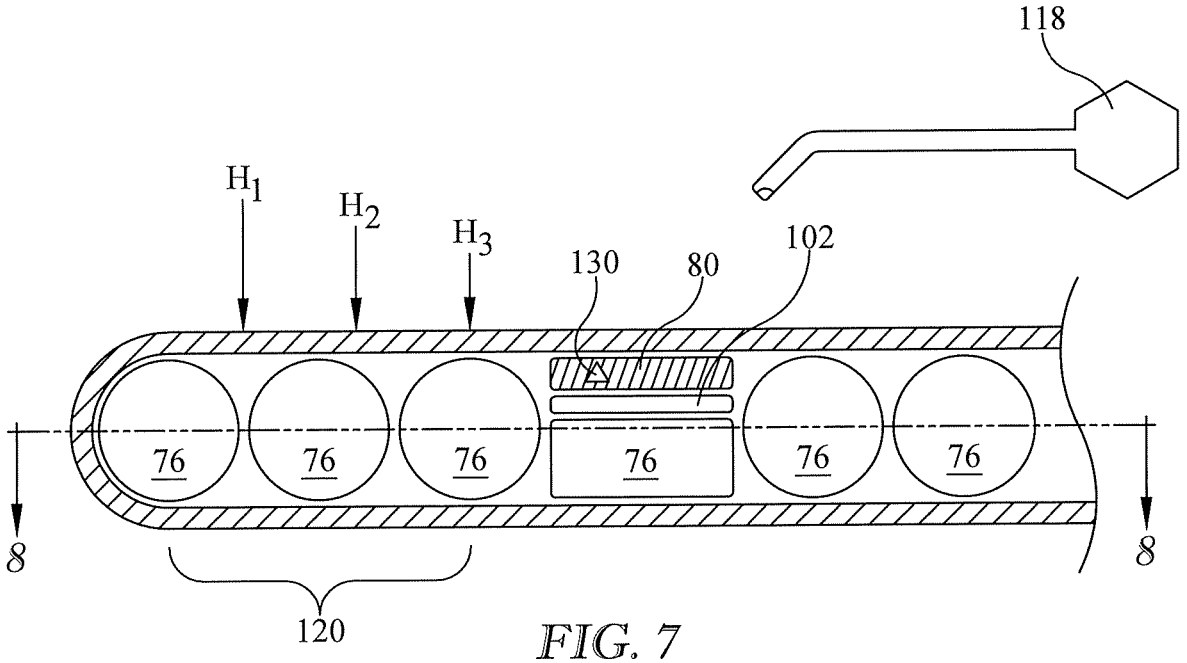
FIGS. 7-8 are views similar to those of FIGS. 2-3 in which the array of heel relief bladders is the limit case of a single heel relief bladder.
Figure 8:
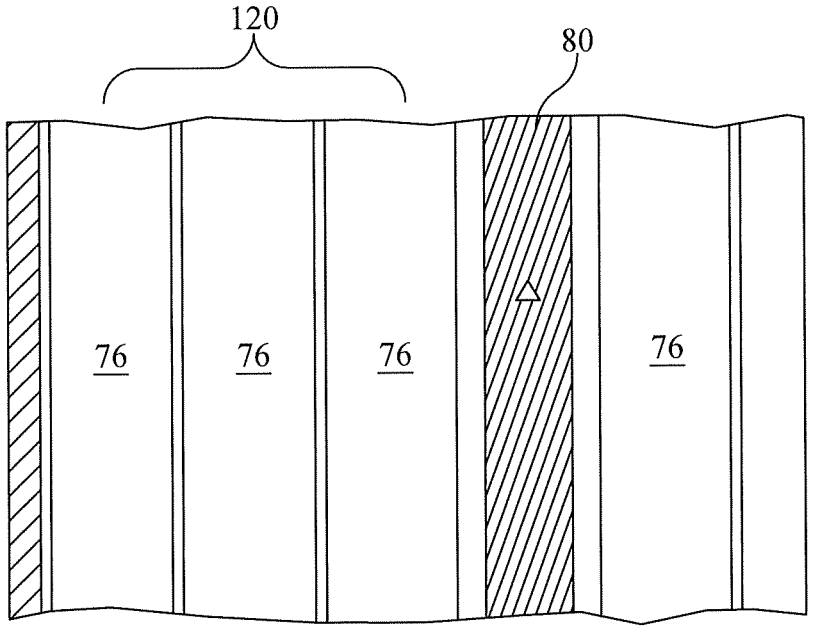
Figure 10:
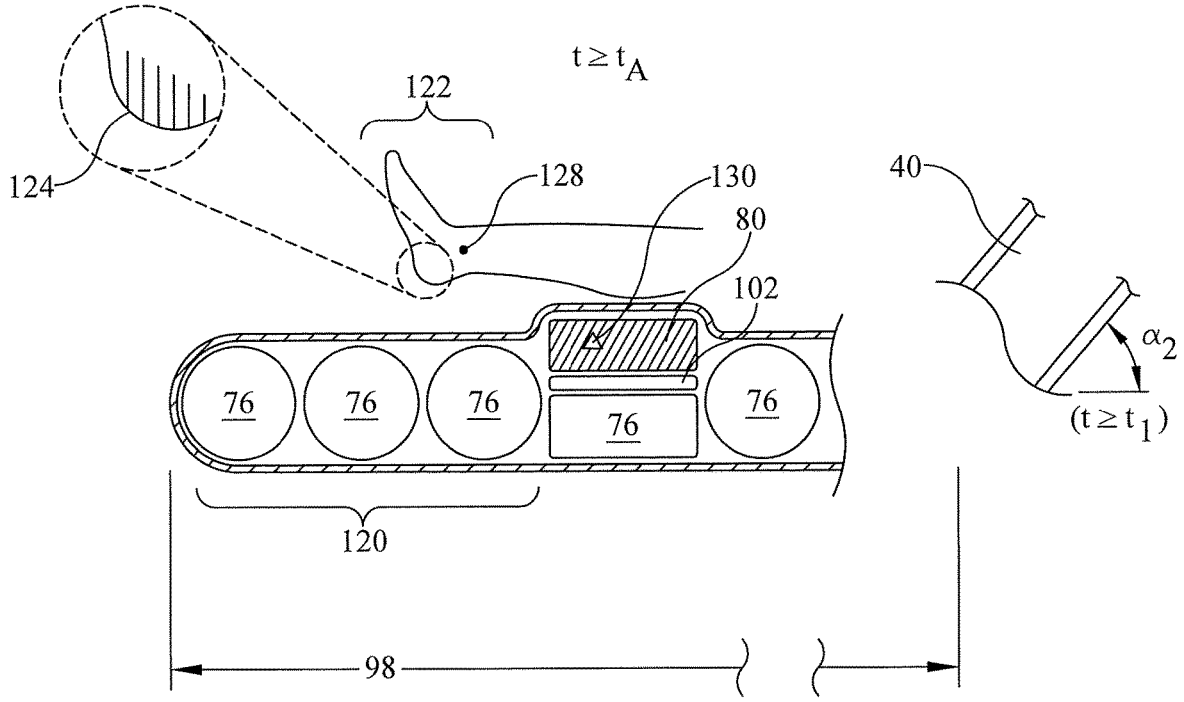
FIGS. 10-12, when viewed in conjunction with FIG. 9, are a sequence of views (FIGS. 9-11) and a set of graphs (FIG. 12) showing a method of resisting skin injuries, and actions carried out by the processor and machine readable instructions of FIG. 1 in order to operate the heel relief bladder or bladders of FIGS. 1-3, 4-5, 7-8, and 9.

Mattress lower body section 98 also includes at least one heel relief bladder 80. As described in more detail below, the heel relief bladders provide temporary support to counteract skin stretch in the vicinity of the occupant's heels. In the example of FIGS. 1-3 the lower body section includes an array of multiple heel relief bladders 80 sufficiently pressurized to provide sustained support to the portion of the occupant's body above the heel relief bladders. These include a footwardmost bladder 80-1, a headwardmost bladder 80-3 and an intermediate bladder 80-2. The example of FIGS. 4-5 includes an array of multiple heel relief bladders 80 which are not sufficiently pressurized to provide sustained support to the portion of the occupant's body above the heel relief bladders. In the example of FIGS. 7-8 the mattress lower body section includes a single heel relief bladder 80 sufficiently pressurized to provide sustained support to the portion of the occupant's body above the heel relief bladders. In FIG. 10 the mattress lower body section includes a single heel relief bladder 80 not sufficiently pressurized to provide sustained support to the portion of the occupant's body above the heel relief bladders. The variants of FIGS. 7-8 and 10 may be thought of as the limit case in which the heel relief bladder array is a single bladder.

The heel relief bladder array is located headwardly of heel region subsection 120, for example at a location longitudinally aligned with the location of the occupant's calves. The heel relief bladder or bladders rest atop a relatively stiff reaction plate 102, which itself is supported by main bladder 76.

As noted above, changing the orientation of the upper body frame segment 40 and upper body mattress section 90 can drive the occupant's heels into the lower body section of the mattress, causing the occupant's skin, in the vicinity of his heels, to stretch and therefore be more susceptible to the development of stretch related skin injuries. The control system relieves the skin stretch by virtue of being adapted to cause mattress heel region subsection 120 to temporarily substantially disengage from the heel region 122 of the occupant in response to a change of angular orientation of the torso section which begins at a time $t_0$. In particular, the heel relief bladder array is inflatable to effect disengagement of the occupant's heel region 122 from mattress heel region subsection 120. The disengagement provides an opportunity for the occupant's stretched skin to return to its unstretched state. The control system is also adapted to cause the heel region subsection to subsequently re-engage with the heel region of the occupant. In particular the bladder array is deflatable to effect re-engagement of the occupant's heel region with the mattress heel region subsection. The re-engagement occurs at a time $t_B$ which is later than $t_0$. Reaction plate 102 helps react forces arising from use of the heel relief bladder or bladders to disengage the occupant's heel region 122 from mattress heel region subsection 120. The reaction plate may not be necessary if the main bladder is satisfactory for reacting the forces on its own.

The phrase "substantially disengaged" and similar phrases used in this specification includes a complete loss of contact between the occupant's heel region 122 and the heel region subsection 120 of the mattress, but also includes light contact between the occupant's heel region and the heel region subsection of the mattress. Light contact constitutes substantial disengagement if the force or forces tending to return the occupant's skin from its stretched state to the relaxed state are large enough to overcome the forces tending to keep the skin in its stretched state. The lighter the contact, the more quickly the skin will return to its relaxed state.

Figure 9:
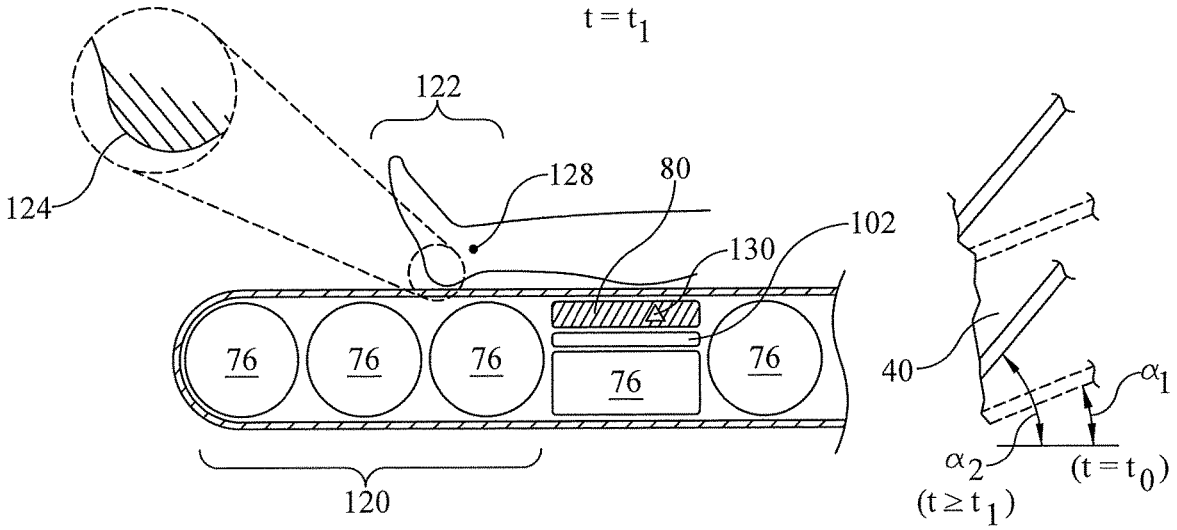
FIG. 9 is a view similar to that of FIG. 4 in which the array of heel relief bladders is the limit case of a single heel relief bladder not sufficiently pressurized to provide support to the patient.
Figure 11:
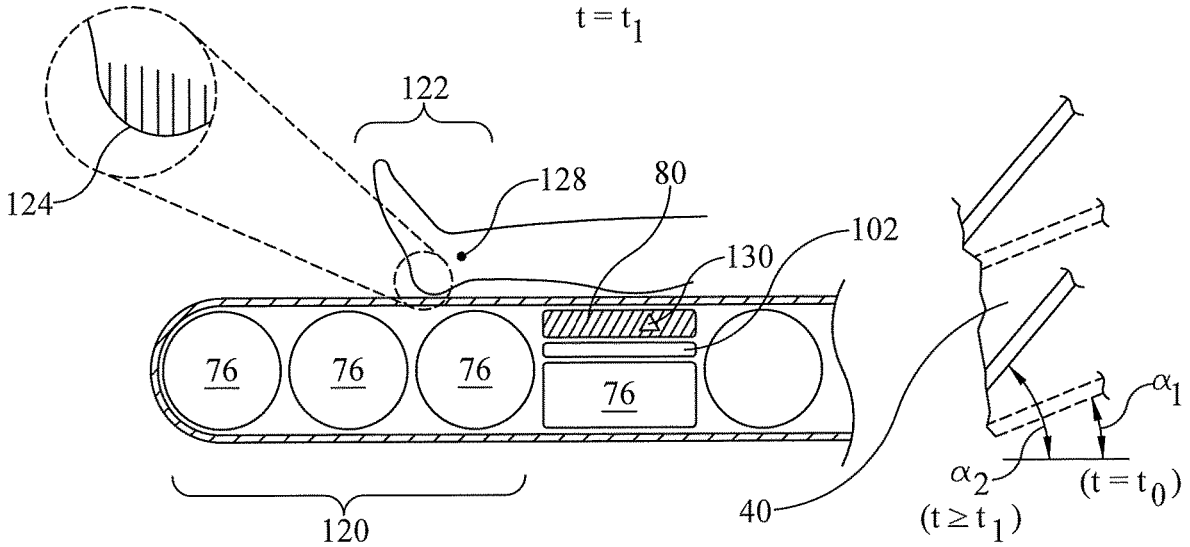
Figure 12:
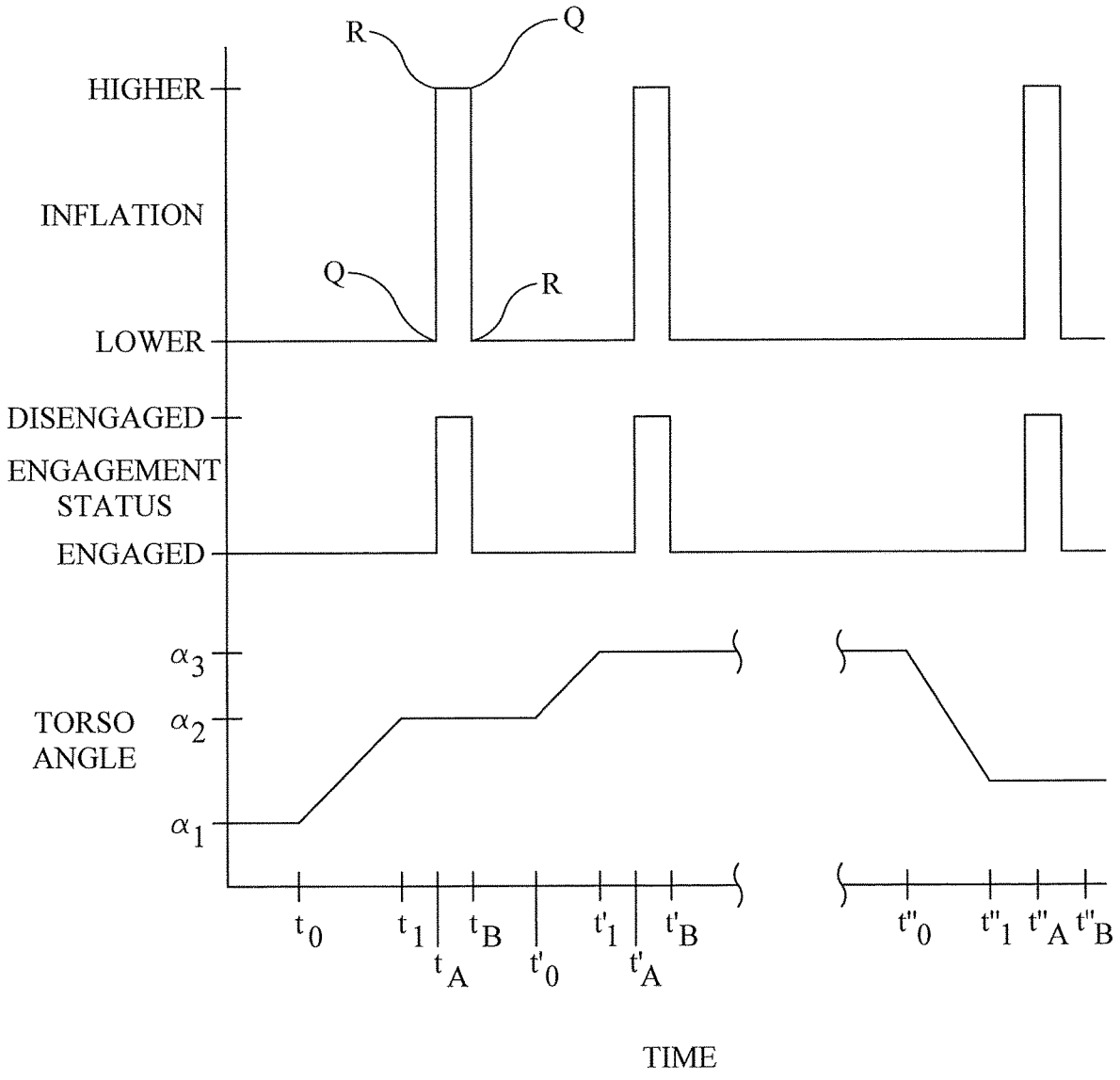

FIGS. 9-11 are a sequence of views showing a method of resisting skin injuries, and actions carried out by the processor and machine readable instructions of FIG. 1 in order to operate the heel relief bladder or bladders of FIGS. 1-3, 4-5, 7-8, and 9. FIG. 12 is an associated set of graphs. Referring first to FIGS. 9 and 12, at time $t_0$ the mattress torso section 40 is at an orientation $\alpha_1$, but begins responding to a command to change its orientation away from horizontal. (Only the mattress ticking is shown in the torso section of FIGS. 9-11; the support components are omitted in the interest of clarity.) At time $t_1$ the orientation change is complete. During time interval $t_0$ to $t_1$, the occupant's heels are in contact with the mattress. Consequently, the orientation change of the torso section drives the occupant's heels into the heel region subsection of the mattress thereby stretching the occupant's skin in the vicinity of his heels. The skin stretch is indicated in FIG. 9 by the oblique hash marks on the occupant's heels.

At a time $t_A$, later than $t_0$, the control system commands inflation of heel relief bladder 80. As seen in FIG. 10, inflation of the heel relief bladder lifts the occupant's calves and therefore lifts his heels so that they are substantially disengaged from heel region subsection 120 of mattress lower body section 98. As a result, the force or forces that had been stretching the skin in the vicinity of the occupant's heels are no longer present, and the skin relaxes back to its unstretched state as indicated by the vertical hash marks on the occupant's heels.

The support provided by the heel relief bladders, when inflated to disengage the occupant's heel region from the heel region subsection of the mattress as seen in FIG. 10, is temporary support, not the sustained support previously described. When the heel relief bladders are not inflated to effect disengagement of the occupant's heel region from the heel region subsection of the mattress, but are inflated as in FIGS. 1-3 and 7-8, they are considered to be contributing to the sustained support provided by the mattress.

The control system then commands deflation of the heel relief bladder 80. As seen in FIG. 11, deflation of the heel relief bladder causes the occupant's calves to re-engage with the mattress lower body section and causes his heel region 122 to re-engage with mattress heel region subsection 120. The re-engagement occurs at a time $t_B$, which is later than time $t_A$ and preferably later than time $t_1$. The occupant's skin remains in the relaxed state as indicated by the vertical hash marks.

The occupant's heel region 120 and mattress heel region subsection 122 remain engaged with each other until another torso section orientation change occurs. In other words, the re-engagement of the occupant's heel region with the mattress heel region subsection marks the conclusion of the actions for addressing the heel region skin stretch resulting from the orientation change of the upper body section during the time interval from $t_0$ to $t_1$. Of course the heel relief action is repeatable by the control system in the event of a subsequent additional change of torso angle $\alpha$. This is seen in the sequence of events in the interval corresponding to the primed time coordinates of FIG. 12.

Applicants believe that positive changes in torso angle are more likely than negative changes to cause enough skin stretch to put the skin at risk of injury. Accordingly, in one embodiment the control system is adapted to cause the temporary substantial disengagement and the subsequent re-engagement of the occcupant's heel region and the mattress heel region subsection only if the angular orientation of the torso section changes in the positive direction, i.e. away from horizontal. Nevertheless, the risk of skin injury during negative changes cannot be ruled out or dismissed as trivial. Therefore in another embodiment the control system is adapted to cause the temporary substantial disengagement and the subsequent re-engagement of the occcupants's heel region and the mattress heel region subsection irrespective of the direction of torso angle change. Heel relief actions carried out in response to a negative change in torso angle is shown at the double primed time coordinates of FIG. 12.

It should also be appreciated that the step changes in the graphs of FIG. 12 are idealizations. For example there will be some time delay between the onset of inflation (or deflation) at points Q and the conclusion of inflation (or deflation) at points R.

As seen in FIG. 12, the action to disengage the occupant's heel region from the mattress heel region subsection begins at time $t_A$ which is no earlier than $t_1$. In one embodiment $t_A$ is approximately equal to $t_1$. In other embodiments $t_A$ may be prior to $t_1$ if disengaging the patient's heel region from the mattress heel region subsection while torso angle $\alpha$ is changing is not contraindicated. However deferring the disengagement until the change of torso angle is complete may have benefits. For example if there are multiple heel relief bladders, one of those bladders will likely be the bladder best suited for disengaging the occupant's heel region from the heel region subsection of the mattress. Which bladder is most suitable may depend on where the patient's calves are positioned relative to the heel relief bladders. The extent to which the torso orientation change pushes the occupant toward the foot end of the bed affects the spatial relationship between the occupant's calves and the individual members of the array of multiple heel relief bladders. Therefore waiting until the torso orientation change is complete, and the occupant is completely migrated, helps ensure accurate identification of the preferred bladder.

Figure 13:
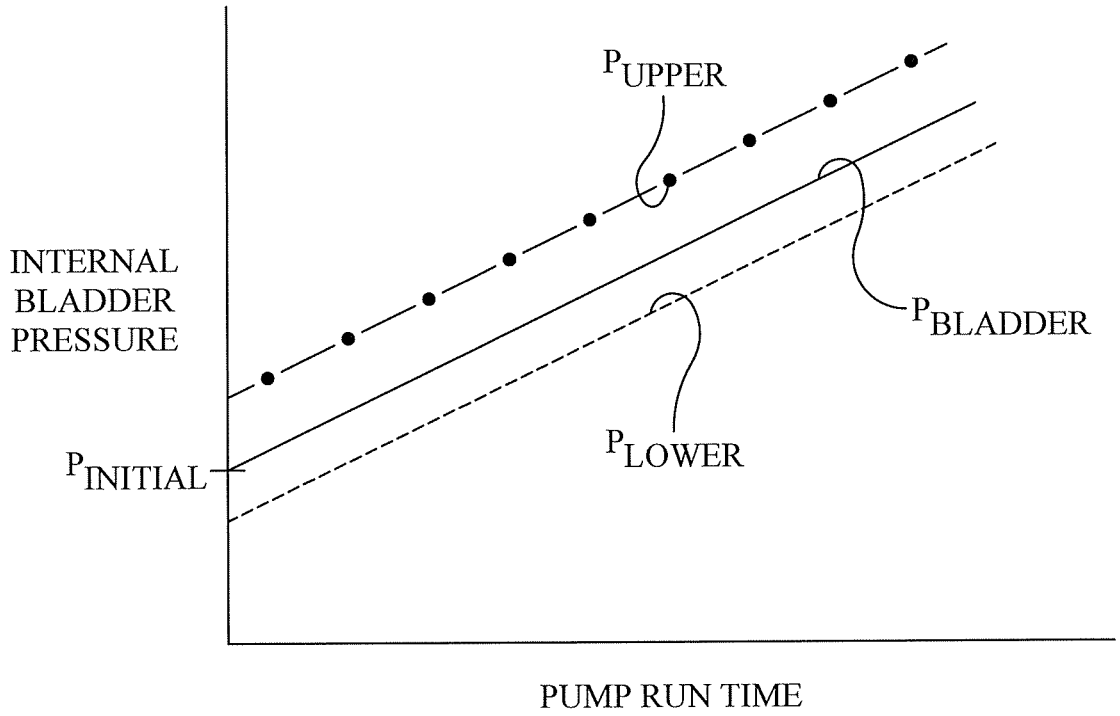
FIG. 13 is a graph illustrating pressure in a heel relief bladder and upper and lower pressure limits.

Continuing to refer to FIGS. 9-11, the bladder may include a transducer 140 such as pressure transducer 140P. Referring additionally to FIG. 13, the control system may be adapted to monitor the pressure $P_{BLADDER}$ in the heel relief bladder during inflation (solid line). Assuming no change in temperature, the pressure will change according to the well known relationship pV=nRT, due to the increasing value of n.

Figure 14:
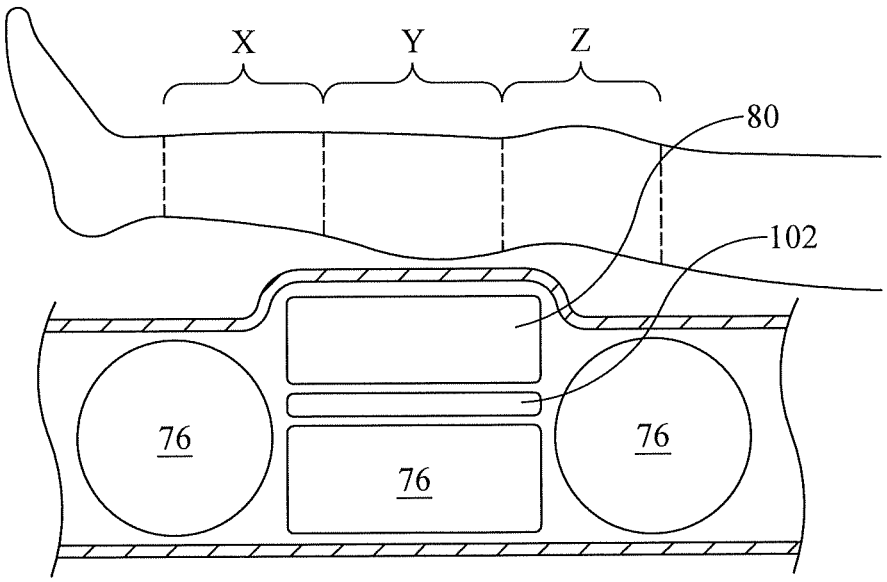
FIG. 14 is a side elevation view of part of a lower body section of a support structure and part of a leg of an occupant of the support structure showing zones X and Z in which applying a lifting force is believed to be less effective or possibly inadvisable in comparison to applying the lifting force in zone Y.

The control system may be adapted to compare the actual bladder pressure $P_{BLADDER}$ to one or more pressure limits such as the upper and/or lower bounds $P_{UPPER}$, $P_{LOWER}$ of FIG. 13. The control system is also adapted to take corrective action if the actual pressure violates a limit. The corrective action may comprise termination of, and possibly reversal of, the inflation of the heel relief bladder. Referring additionally to FIG. 14, such deviation may be the result of, for example, patient mispositioning on the bed such that the heel relief bladder is in zone X, too close to his ankle, or zone Z, too close to his knee. The termination or reversal of bladder inflation reflects a belief that applying a lifting force outside of zone Y may be ineffective in disengaging the occupant's heel region from the mattress heel region subsection or a belief that applying a lifting force outside of zone Y is inadvisable.

The method and actions described above are in connection with FIGS. 9-12 and therefore are in the context of a single heel relief bladder which is not initially pressurized enough (i.e. prior to time $t_A$) to sufficiently support the portion of the occupant's body above the bladder. However the same description applies to the bladder arrays of FIGS. 1-3, FIGS. 4-5, and FIGS. 7-8.

Figure 15:
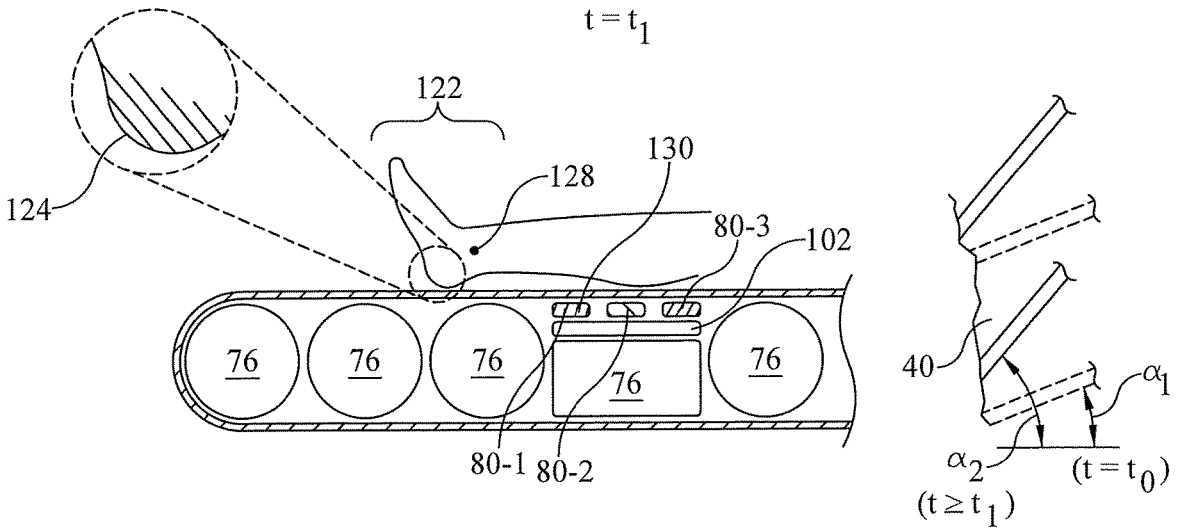
FIGS. 15-17 are elevation views similar to those of FIGS. 9-11 in which the array of heel relief bladders includes more than one bladder.
Figure 16:
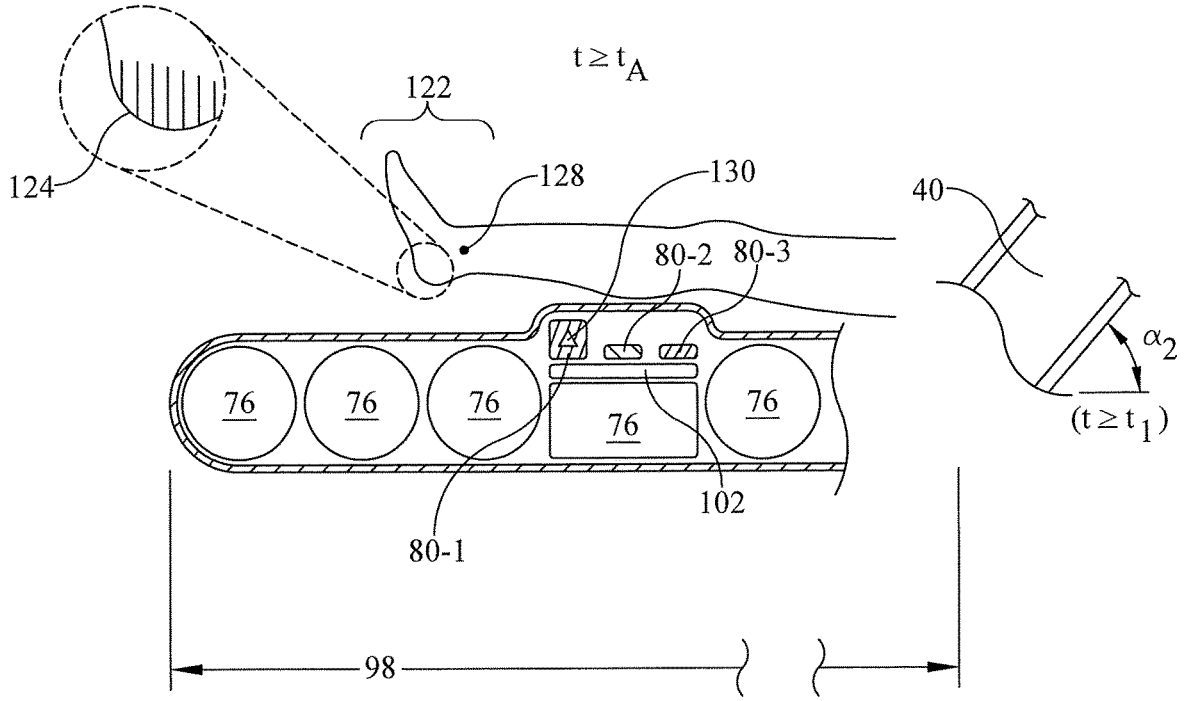
Figure 17:
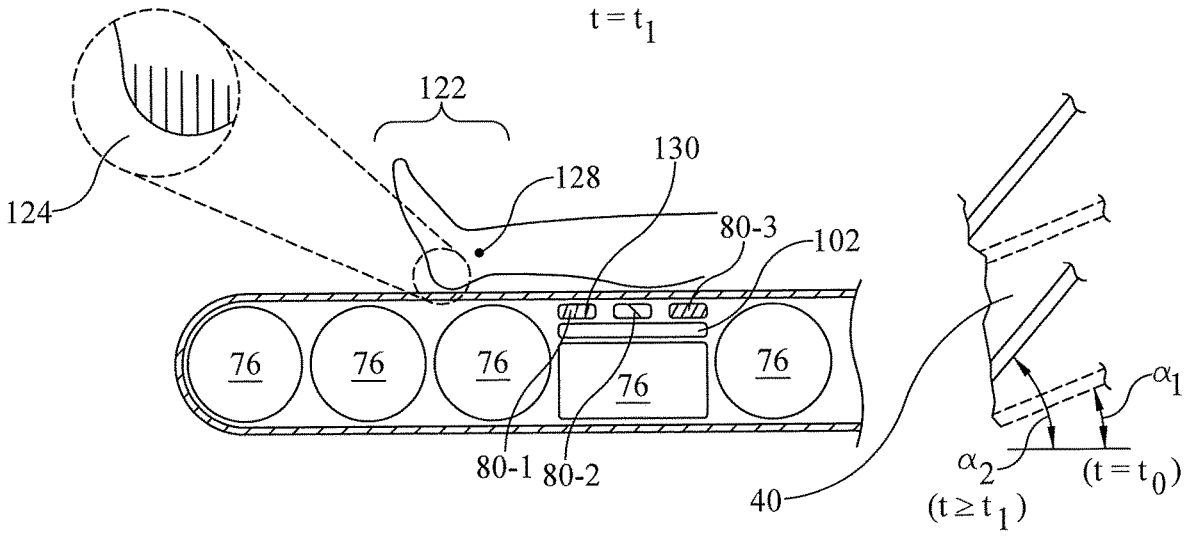

In the cases of bladder arrays having multiple bladders (FIGS. 1-3 and 4-5), inflation of the bladder array may involve inflation of all the bladders of the array. Alternatively, inflation of the bladder array may involve inflation of fewer than all members of the array. FIGS. 15-17 (and the graphs of FIG. 12) repeat the example of FIGS. 9-11 for an array of multiple bladders. In comparison to the single heel relief bladder arrangements of FIGS. 7-8 and 9, the multiple bladder arrays offer additional functionality due to the option to inflate fewer than all of the bladders of the array.

Referring to the arrangements having multiple heel relief bladders 80, each bladder may include a transducer 140 such as a pressure transducer 140P. In one example of an additional functionality, the control system is adapted to select a subset of the heel relief bladders 80 and to inflate and deflate only the subset to effect the disengagement of the occupant's heel region 122 from mattress heel region subsection 120 and subsequent re-engagement of the occupant's heel region with the mattress heel region subsection. In the limit, the subset is a single heel relief bladder of the multi-bladder array.

The longitudinal distribution of the bladders, and the adaptation of the control system to select only a subset of the bladders for inflation and deflation helps ensure that the bladder subset, when inflated, acts on zone Y of the occupant's calf rather than on zones X or Z. As a result the occupant support structure accommodates occupants of differing heights. For example, referring to FIG. 2, if the occupant is tall, his heel region might reside at location $H_1$, and the approximate center of calf zone Y might reside at location $C_1$. It would therefore be appropriate to employ heel relief bladder 80-1 to carry out the disengagement and re-engagement of the occupants' heel region 122 and mattress heel region subsection 120. If the occupant is of moderate height his heel region might reside at location $H_2$, and the approximate center of zone Y of his calf might reside at location $C_2$. It would therefore be appropriate to employ heel relief bladder 80-2 to carry out the disengagement and re-engagement. If the occupant is short his heel region might reside at location $H_3$, and the approximate center of zone Y of his calf might reside at location $C_3$. It would therefore be appropriate to employ heel relief bladder 80-3 to carry out the disengagement and re-engagement.

In order to select the bladder to be inflated to effect the engagement and disengagement of the occupant's heel region and the mattress heel region subsection, the control system may be adapted to command a test inflation of each of the bladders and to include in the selected subset whichever bladder the test inflation reveals to be most suitable to effect the engagement and disengagement.

Figure 18:
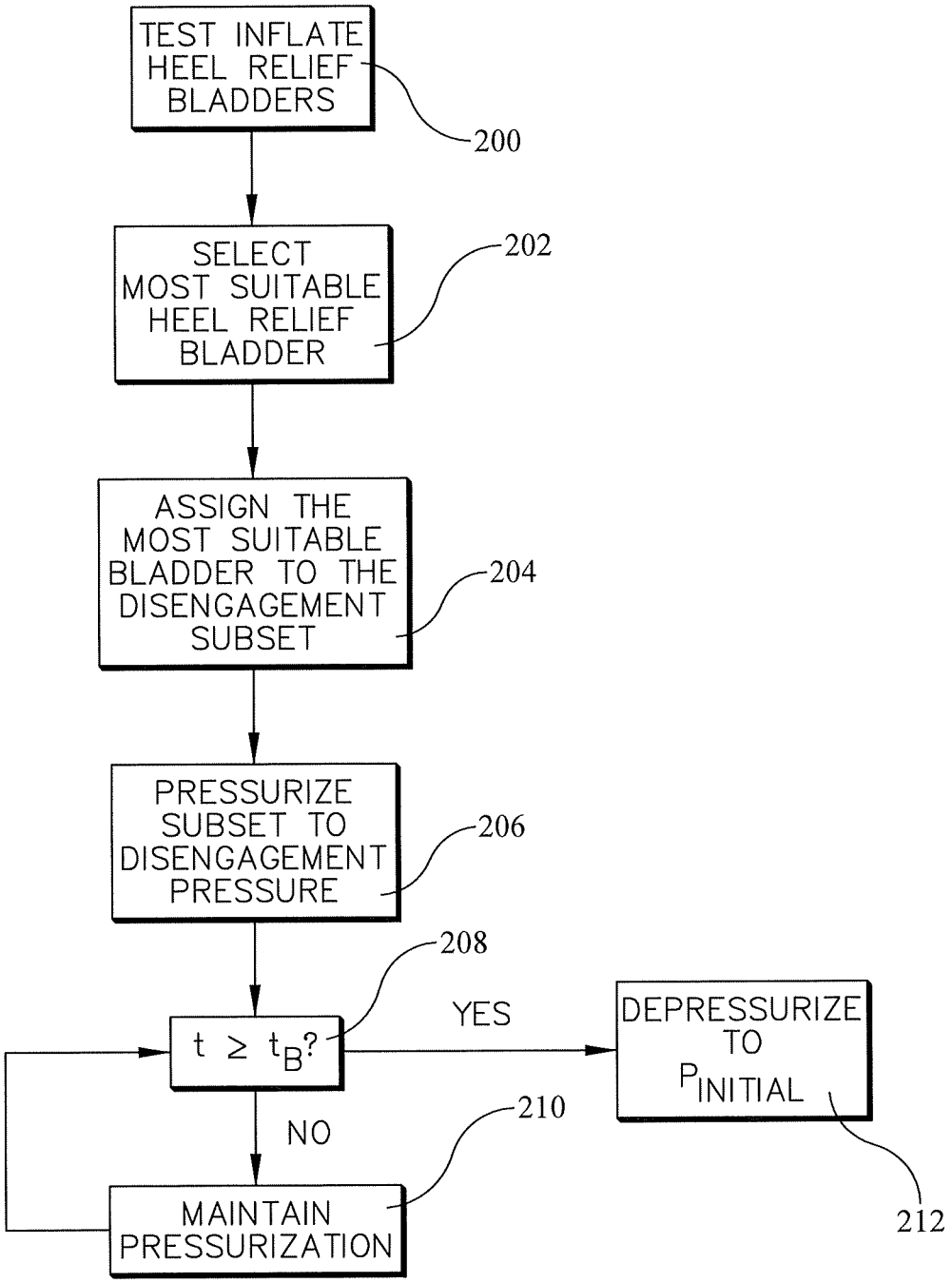
FIG. 18 is a block diagram showing test inflation of a bladder array which includes more than one bladder, the test inflation being adapted to select a bladder subset most suitable for use during a non-test mode of operation.

Referring to FIG. 18, in one embodiment the test inflation involves partial inflation of all the bladders of the heel relief bladder array, either sequentially or concurrently (block 200). Partial inflation means inflation or pressurization less than that necessary to substantially disengage of the occupant's heel region from the mattress heel region subsection. Processor 110 executes appropriate instructions of the machine readable instruction set 114 to analyze the readings from transducers 140. At block 202 processor 110 uses the results of the analysis to select whichever bladder the test inflation reveals to be most suitable to effect the disengagement. In one embodiment suitability is judged by determining which bladder is most heavily loaded by the test inflation (i.e. which bladder exhibits the highest internal pressure).

Once the most suitable heel relief bladder is identified, the processor includes only that bladder in the subset (block 204). At block 206 processor 110 commands inflation and deflation of that bladder to effect the disengagement of the occupant's heel region from the mattress heel region subsection. The test inflation of the nonselected bladders may be reversed (i.e. the nonselected bladders may be deflated) or the nonselected bladders may be left temporarily in their partially inflated test state and deflated at a later time.

At block 208 the processor determines whether the time to depressurize the bladder subset has arrived. The determination could be in the form of a specified time delay relative to time $t_4$. If not, pressurization is maintained (block 210). If so, the bladder subset is depressurized at block 212. If the nonselected heel relief bladders were previously left in their test state, those bladders are also deflated to their original state. As already noted, the original state may be one of sufficient inflation to provide sustained support of the portion of the occupant's body above the heel relief bladders, or may be a state in which the heel relief bladders do not provide any meaningful sustained support to the occupant.

The foregoing example selects only a single bladder to include in the subset of heel relief bladders to be inflated. Alternatively, instructions 114 can be written to include the option of selecting two or more bladders or to require the selection of two or more bladders.

When the heel relief bladder array comprises two or more bladders, and the selected subset includes two or more bladders, the control system may be adapted to inflate the selected bladders concurrently or at least partially nonconcurrently. One example of nonconcurrent inflation is sequential inflation beginning with the headwardmost bladder and proceed progressively toward the footwardmost bladder (80-1, 80-2, 80-3) or vice versa. Another example is a nonprogressive inflation, e.g. 80-2, 80-1, 80-3.

Other mattress bladder arrangements may also be satisfactory. For example FIGS. 40-41, 44-45 and 46-48 of pending, commonly owned U.S. Provisional Patent Application 62/667,769 entitled "Patient Support Surface Control, End of Life Indication, and X-Ray Cassette Sleeve" filed on May 7, 2018 show pneumatic arrangements in which an adjustment to the mattress disengages the heel region subsection of the mattress from the heel region of the occupant by elevating the occupant's calves, albeit not in response to elevation of the torso section of the disclosed occupant support structure. The substantive content of FIGS. 40-41, 44-45 and 46-48 of the '769 application are reproduced as FIGS. 19-20, 21-22 and 23-25 of the present application for the convenience of the reader. The contents of application Ser. No. 62/667,769 and related U.S. Provisional Patent Application 62/635,749 entitled "Patient Support Surface Control, End of Life Indication, and X-Ray Cassette Sleeve" filed on Feb. 27, 2018 are both incorporated herein by reference.

Non-pneumatic arrangements may also be satisfactory. For example FIGS. 49-50, 51-52, 53-54 and 55-56 of application Ser. No. 62/667,769, the substance of which are reproduced as FIGS. 26-27, 28-29, 30-31 and 32-33 of this application, show non-pneumatic adjustments of the mattress.

Arrangements in which a mechanical component of the bed frame, e.g. elevatable frame 24, are used to carry out adjustments to the mattress may also be satisfactory. Examples are seen at FIGS. 34-35, 36-37, 38-39, 57-58 and 59-60 of application Ser. No. 62/667,769, the substance of which are reproduced as FIGS. 34-35, 36-37, 38-39, 40-41 and 42-43 of this application. In all of these arrangements the frame component of the occupant support structure includes a mechanism which is operable to cause the mattress heel region subsection to disengage from and re-engage with the heel region of the occupant.

In the occupant support structures shown in at least FIGS. 1-3, 4-5, 7-8, 9-11, and 15-17, the control system is adapted to temporarily substantially disengage the mattress heel region subsection 120 from an anatomical region of concern, and to cause subsequent re-engagement, by controlling a mattress component which is longitudinally offset from the anatomical region of concern. Specifically, the control system controls inflation of the heel relief bladder or bladders 80, which are longitudinally offset from the occupant's heel region 122 and from mattress heel region subsection 120.

Figure 42:
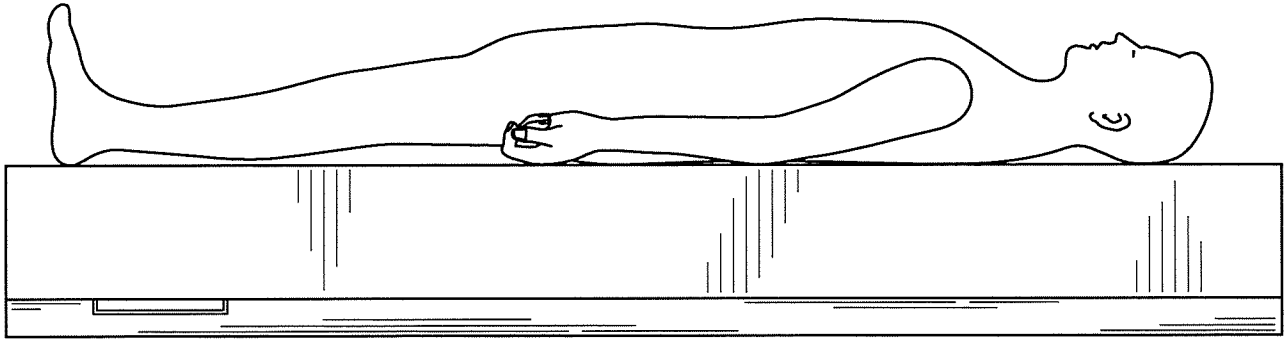
Figure 43:
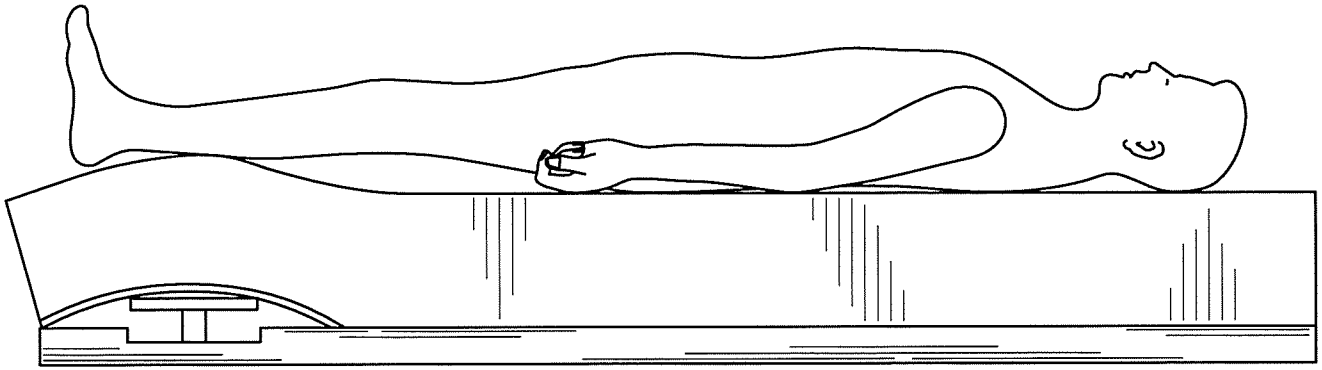
Figure 44:
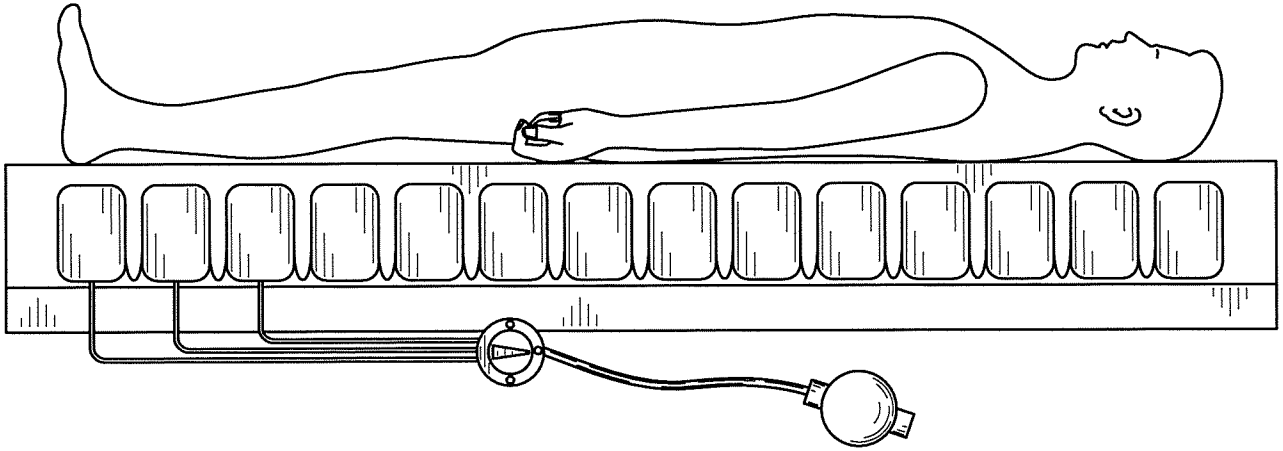
Figure 45:
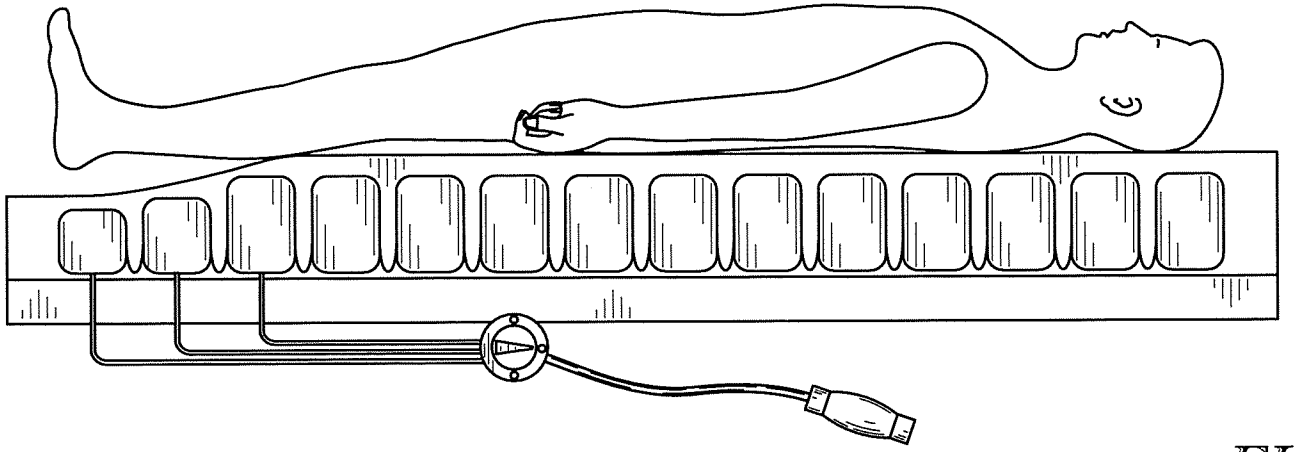

In another embodiment, the control system is adapted to temporarily substantially disengage the mattress heel region subsection 120 from the occupant's heel region 122, and to cause subsequent re-engagement, by controlling a component of the occupant support structure which is longitudinally aligned with mattress heel region subsection 120 and therefore longitudinally aligned with the occupant's heel region 122. One example is shown at FIGS. 42-43 application Ser. No. 62/667,769, the substance of which is reproduced as FIGS. 44-45 of this application.

Another embodiment of the occupant support structure involves a modification to a foot extension of the type found on some hospital beds. Referring first to the solid lines of FIG. 46, deck calf segment 46 includes an extension panel 134 having a footboard 136. An actuator 140, illustrated as a pneumatic cylinder 142 and a piston 144, is affixed to the frame. When a caregiver finds that the bed is too short to accommodate a tall patient, the caregiver can lengthen the bed by causing the actuator to operate in a way that extends the piston, and therefore extends the extension panel as depicted by the solid lines. When a caregiver finds that the bed is longer than necessary to accommodate a short patient, the caregiver can shorten the bed by causing the actuator to operate in a way that retracts the piston, and therefore the extension panel, as depicted in phantom. Footboard 136 compresses mattress 70 to accommodate the shorter length of the frame.

Figure 46:
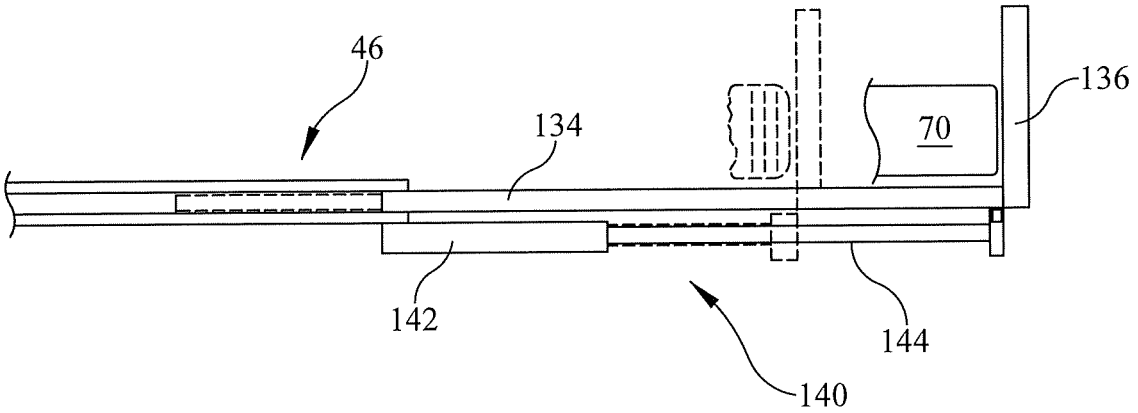
FIG. 46 is a schematic, side elevation view of a portion of a prior art bed frame having a foot extension.
Figure 47:
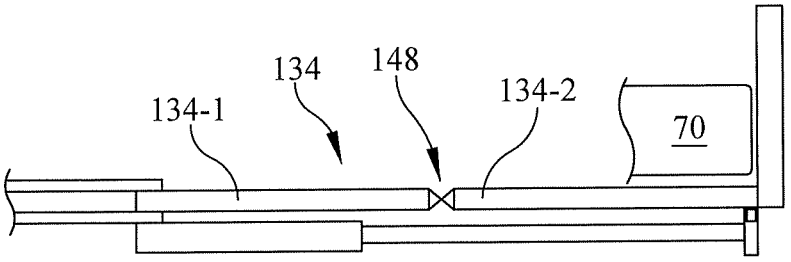
FIG. 47 is a view similar to that of FIG. 46 showing a modification to the foot extension for achieving the skin injury resistance described in this specification.
Figure 49:
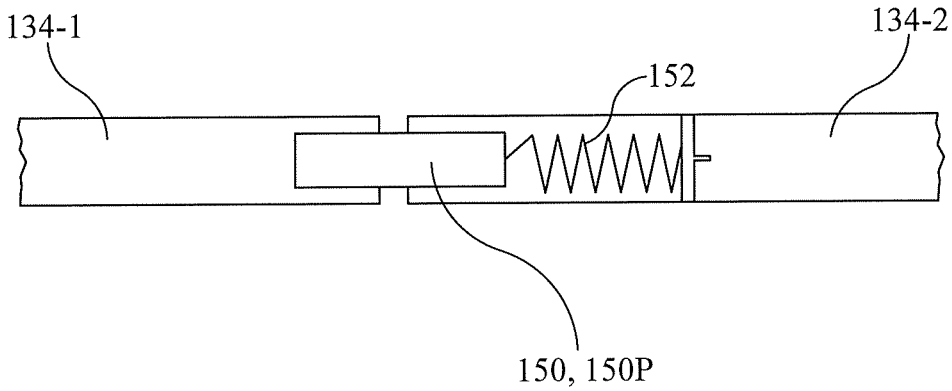
FIGS. 49-50 are schematic side elevation views of a locking element of the modified foot extension of FIG. 47 in a deployed state (FIG. 49) and a retracted state (FIG. 50).
Figure 50:
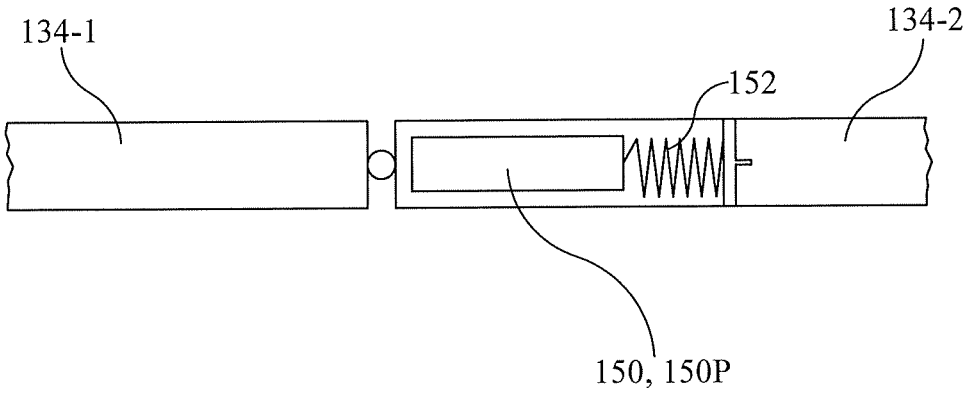

FIG. 47 shows the modified version of the foot extension system. Extension panel 134 comprises first and second subpanels 134-1, 134-2 connected together by a hinge 148. Referring additionally to FIGS. 49 and 50, the modified version of the foot extension system also includes a locking element 150. The illustrated locking element is a pin or a series of laterally distributed pins 150P. The pin is spring loaded by spring 152 into the locked position of FIG. 49, in which position the locking element constrains the first and second subpanels to remain parallel to each other as they extend or retract, just as seen in FIG. 46.

In order to disengage the occupant's heel region from the heel region subsection of the mattress, the control system commands withdrawal of pin 150P from the first subpanel. For example pin 150P may be an element of a solenoid, and the instructions executed by processor 110 may cause power to be supplied to the solenoid, thereby overcoming the force exerted by spring 152 and withdrawing the pin from the first subpanel.

Figure 48:
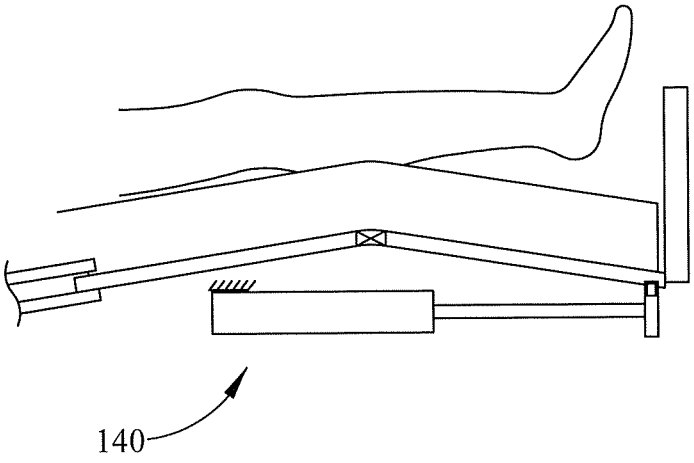
FIG. 48 is a view similar to that of FIG. 47 showing operation of the modified foot extension.

Referring to FIG. 48, the control system also commands actuator 140 to operate in the retract direction. Because pin 150P no longer connects the second subpanel to the first subpanel, the subpanels can change orientation relative to each other, thereby disengaging the occupant's heel region 122 from the heel region subsection 120 of the mattress.

Figure 19:
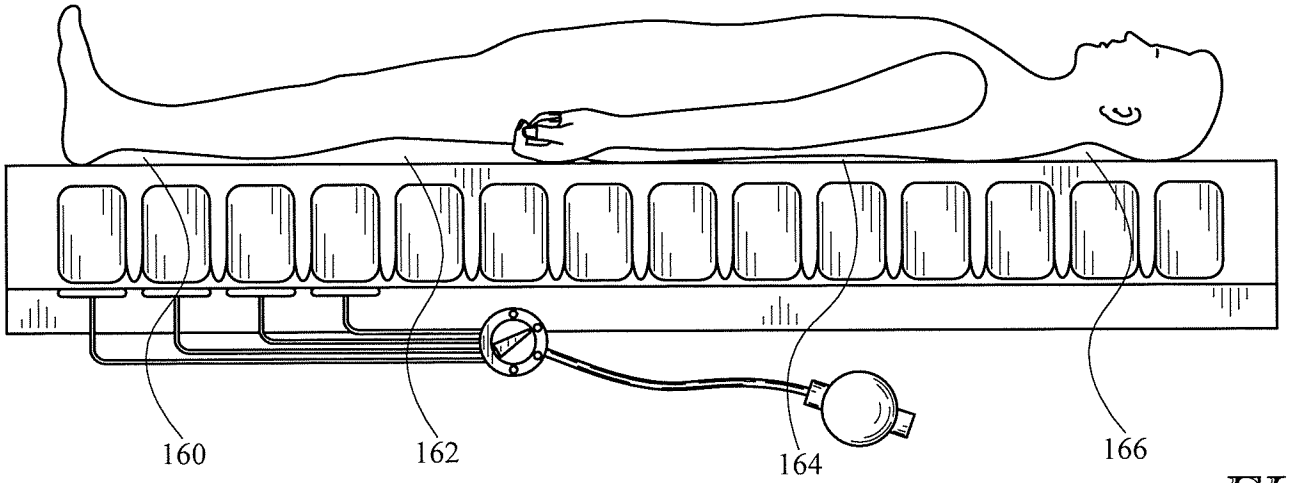
FIGS. 19-45 are left side elevation views showing alternative architectures for achieving the skin injury resistance described in this specification.
Figure 20:
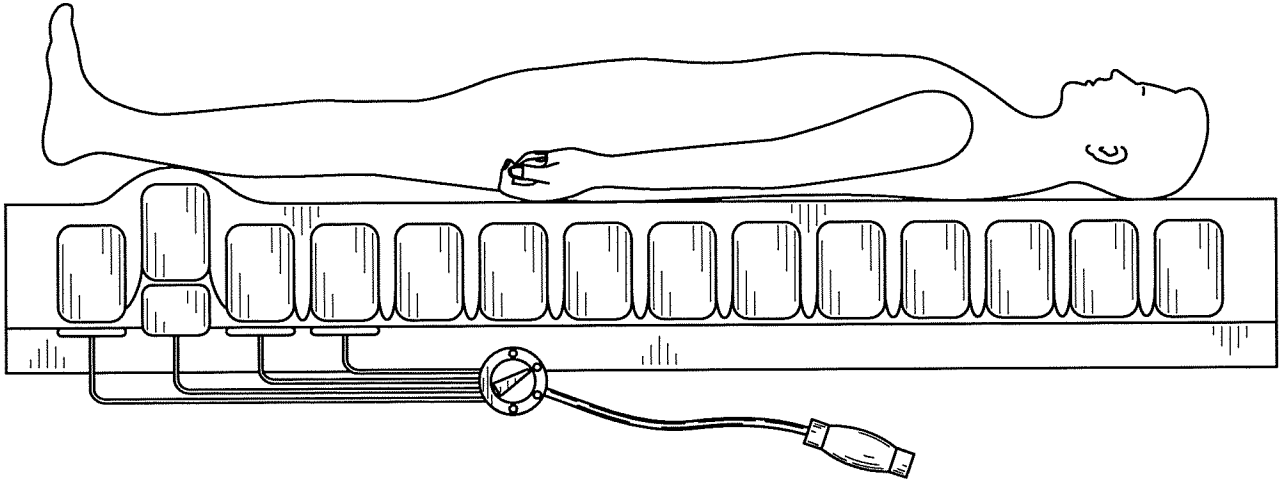
Figure 21:
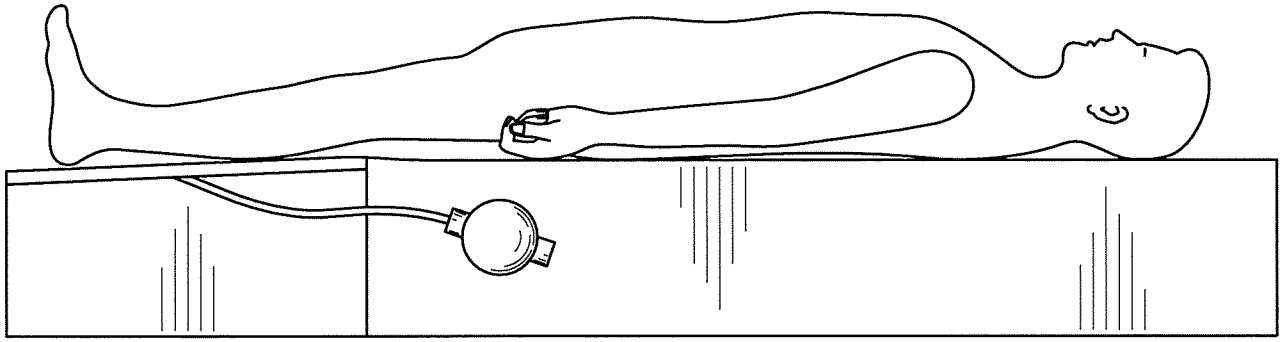
Figure 22:
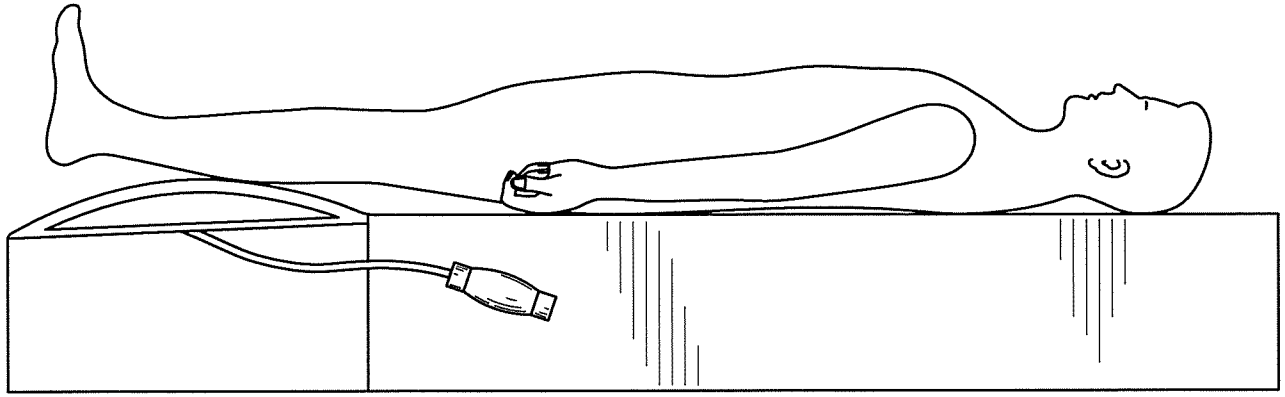
Figure 23:
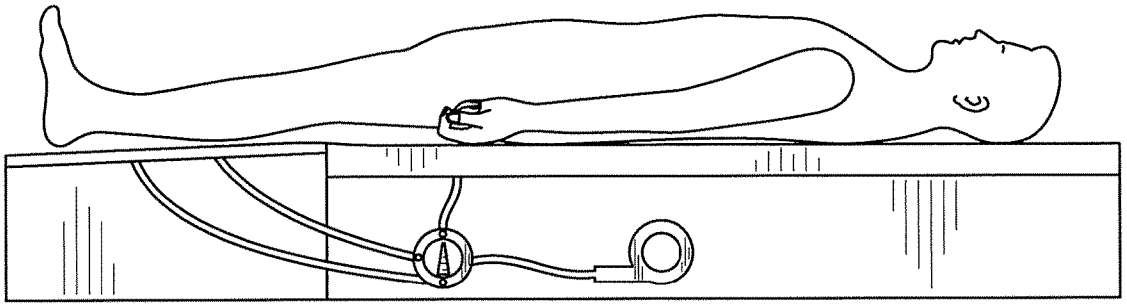
Figure 24:
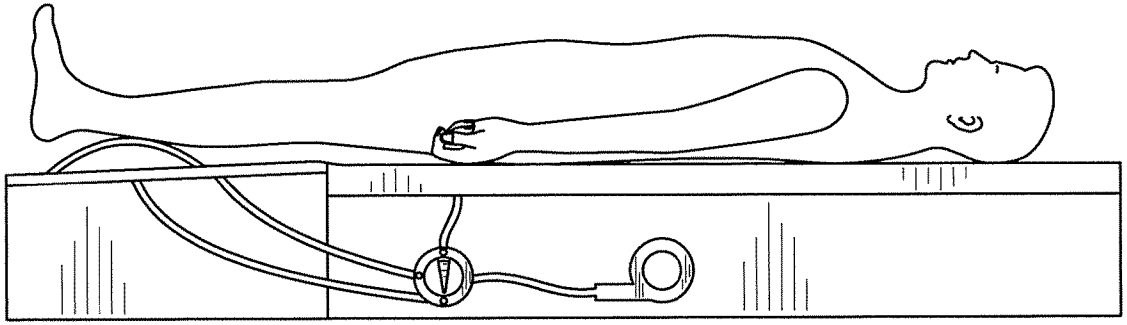
Figure 25:
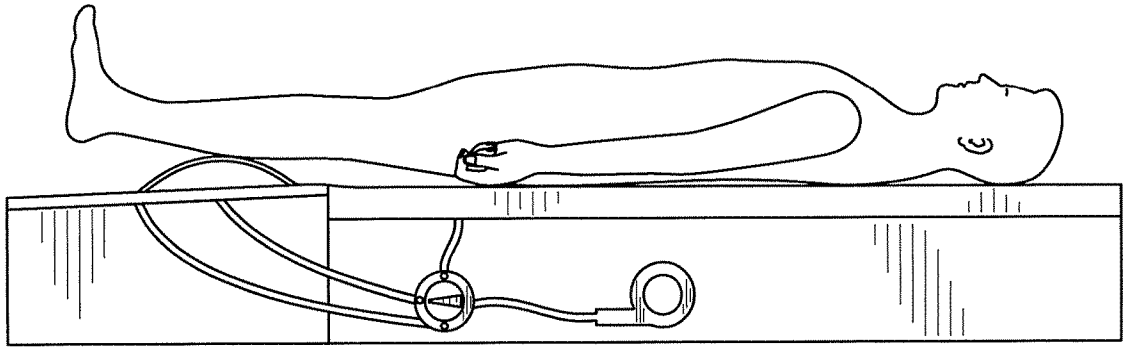
Figure 26:
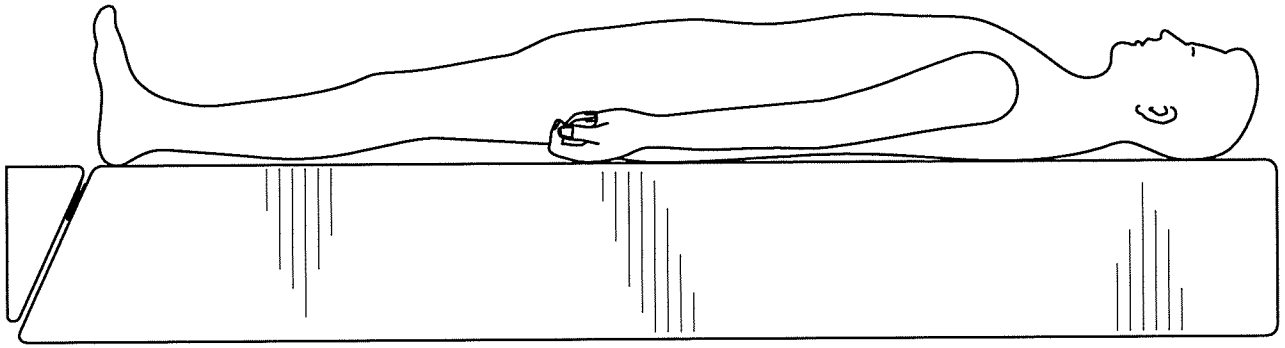
Figure 27:
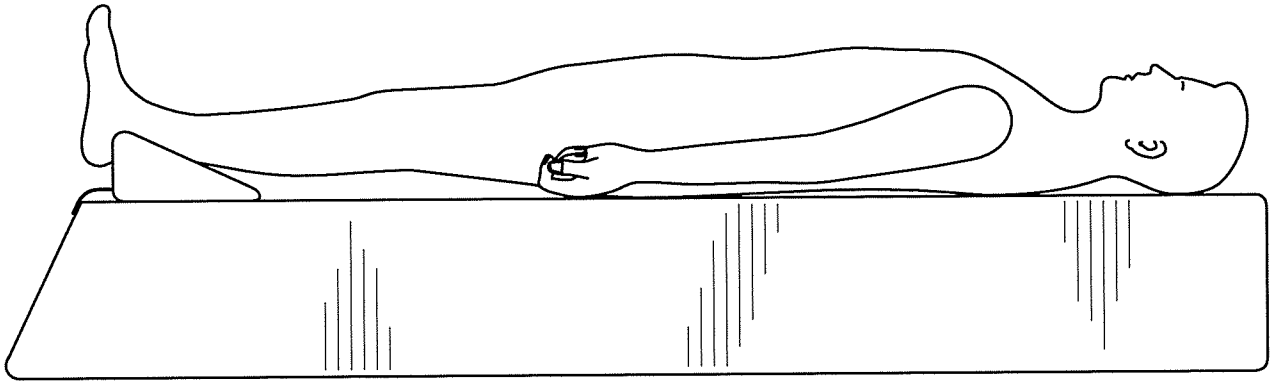
Figure 28:
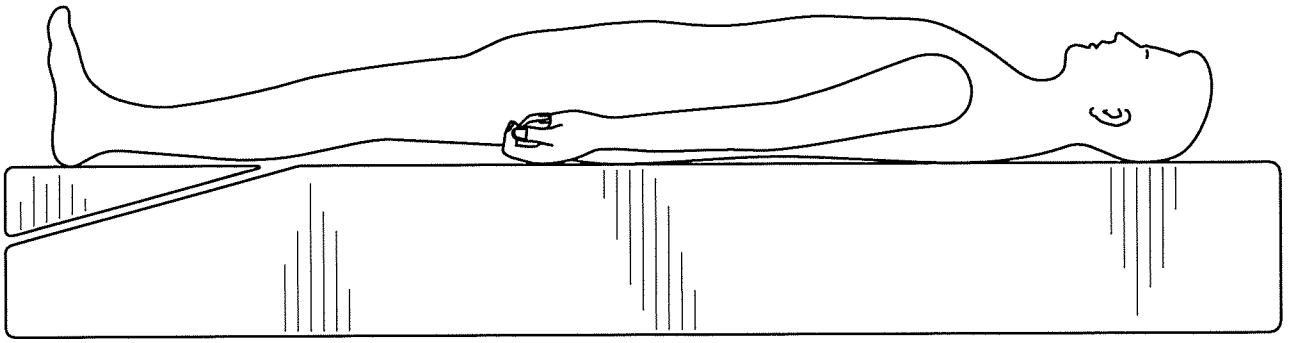
Figure 29:
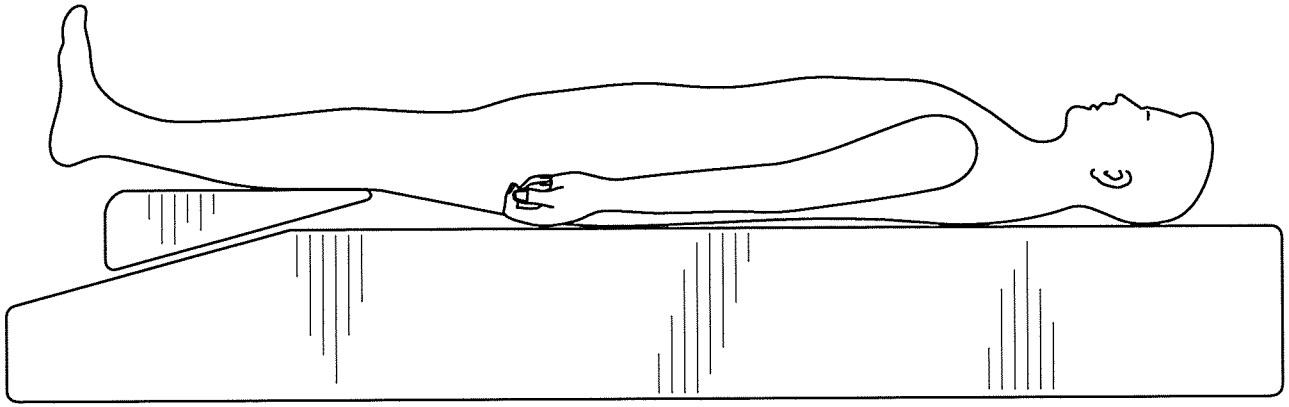
Figure 30:
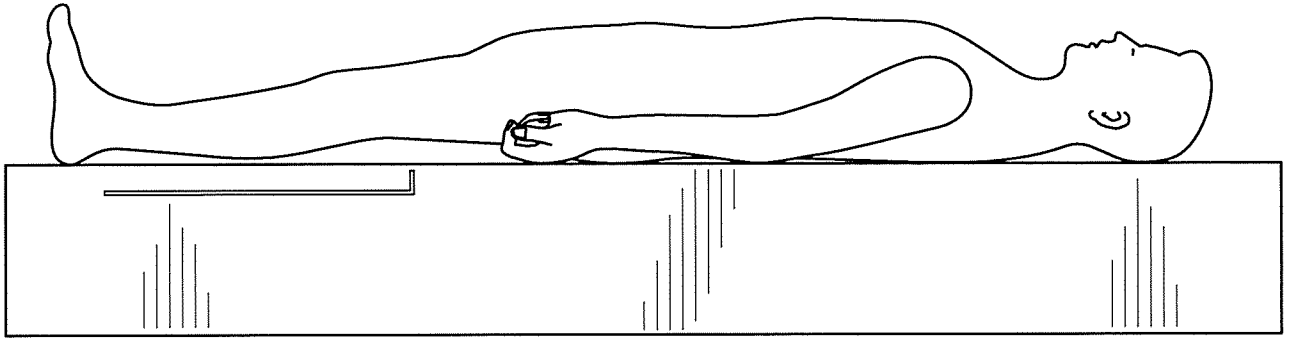
Figure 31:
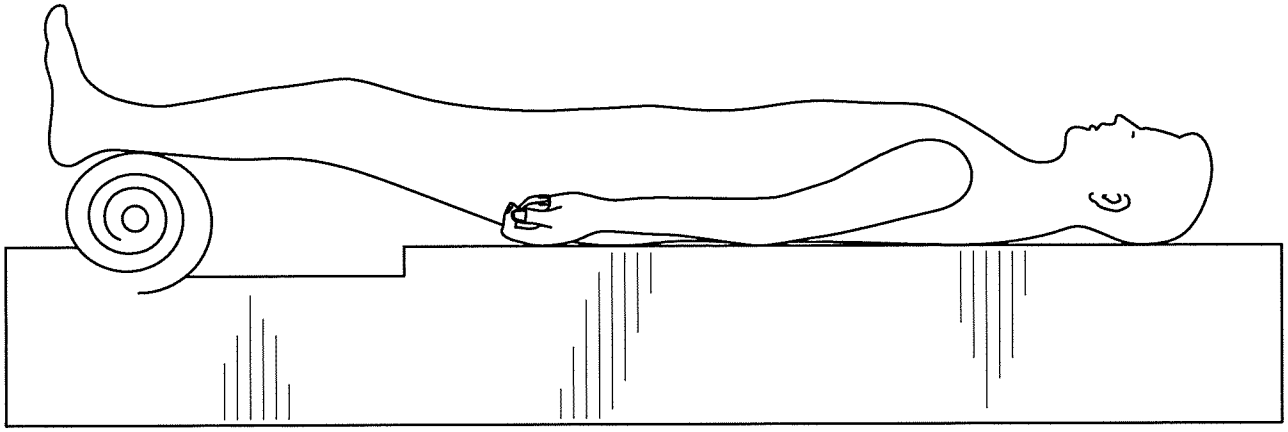
Figure 32:
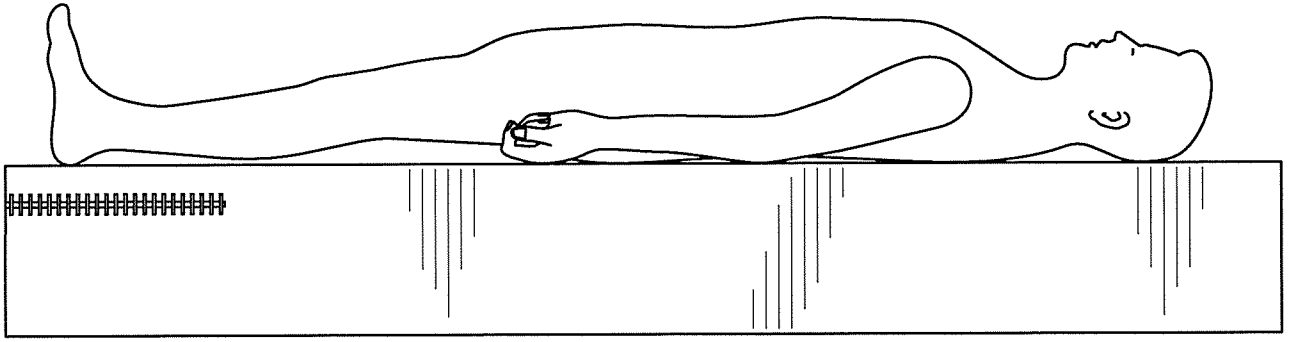
Figure 33:
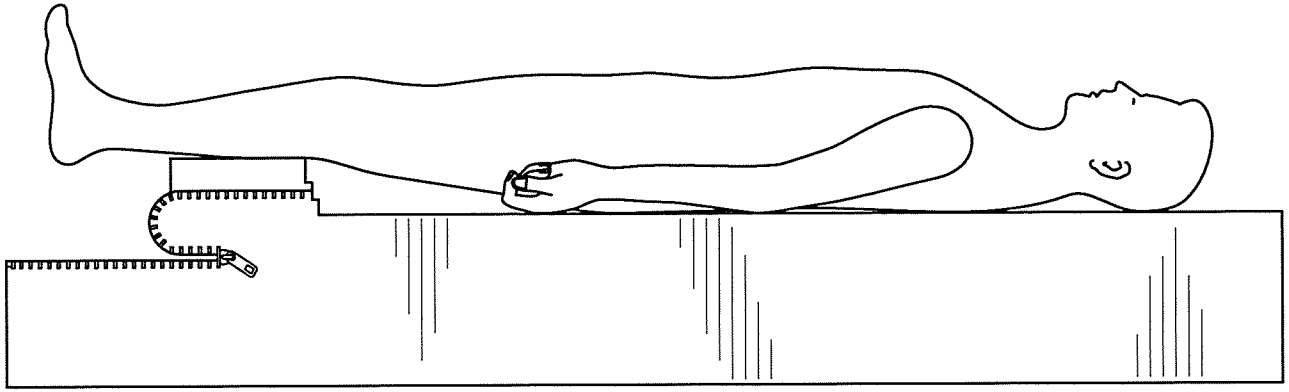
Figure 34:
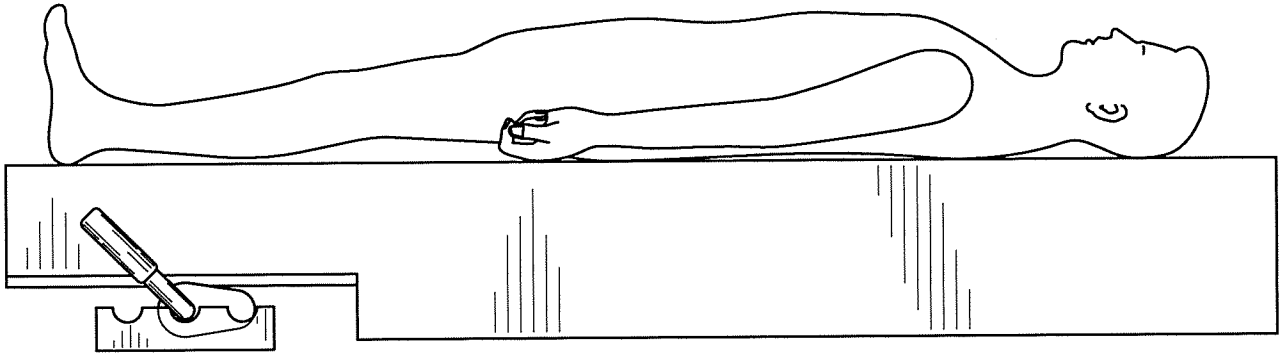
Figure 35:
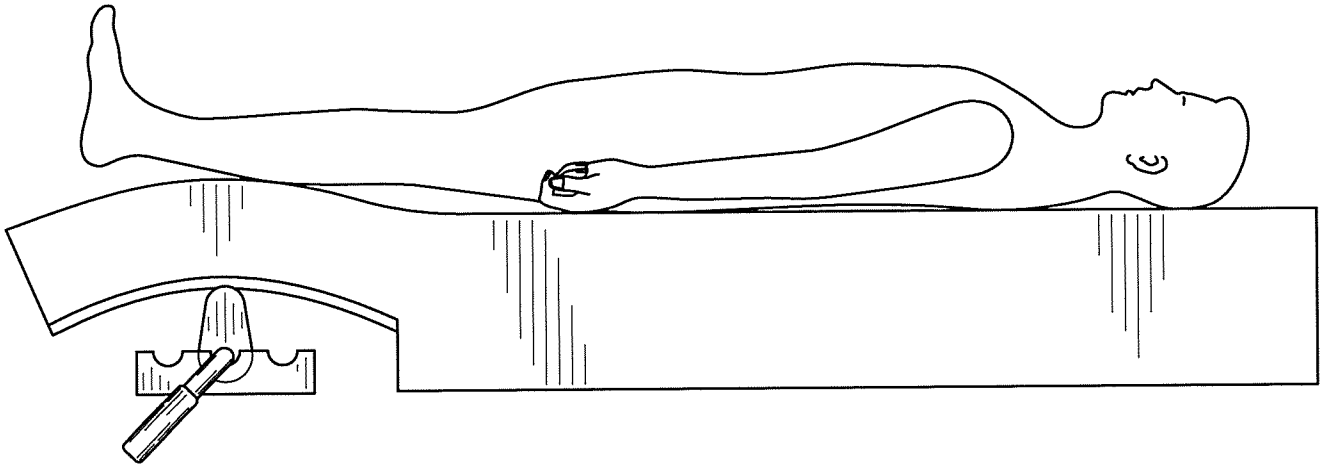
Figure 36:
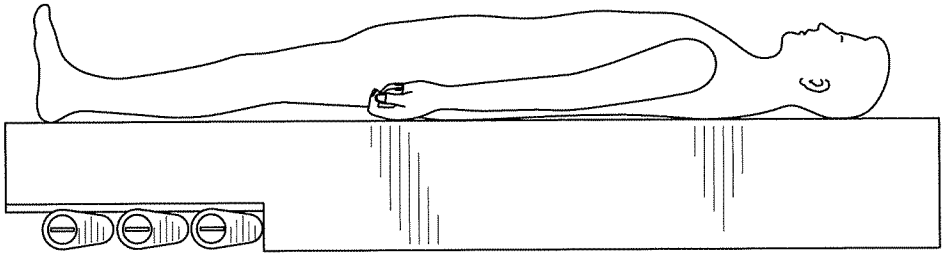
Figure 37:
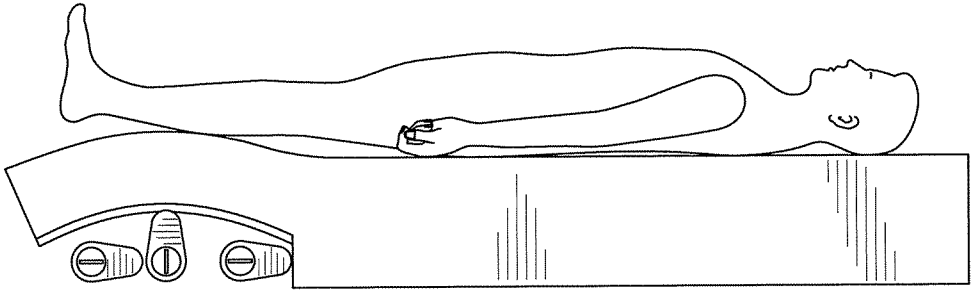
Figure 38:
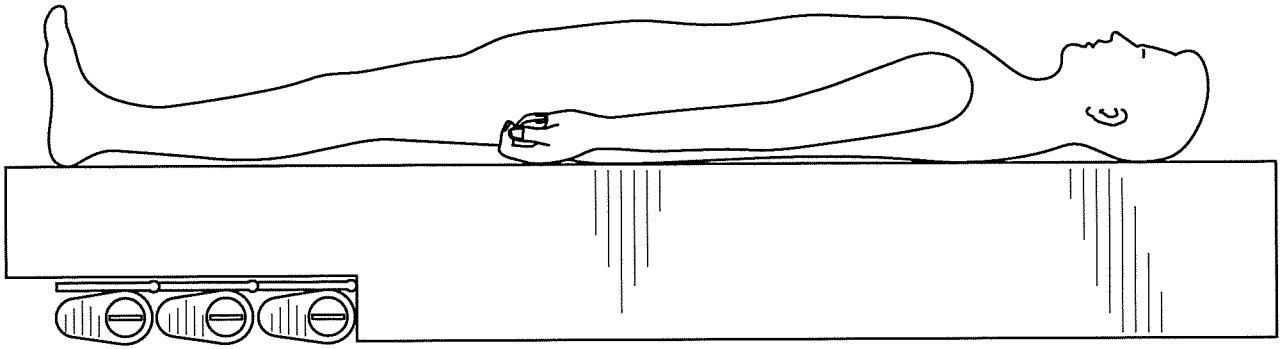
Figure 39:
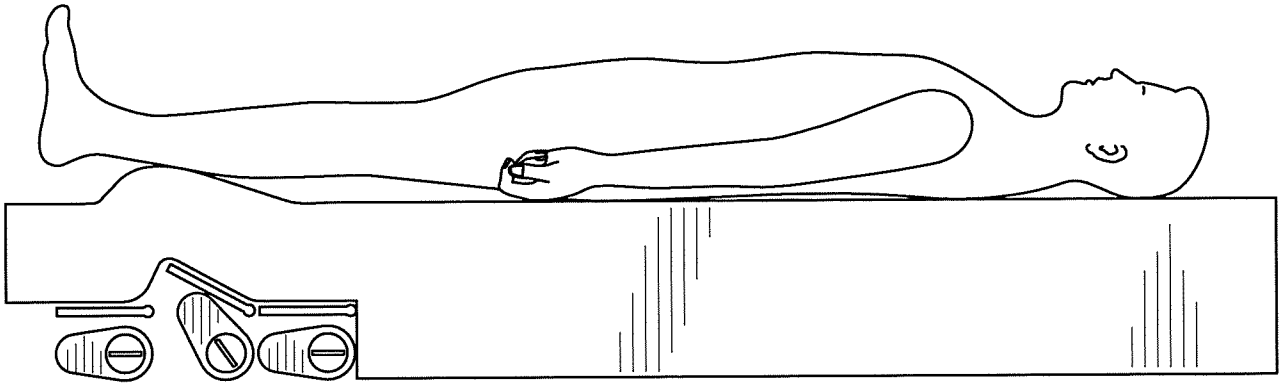
Figure 40:
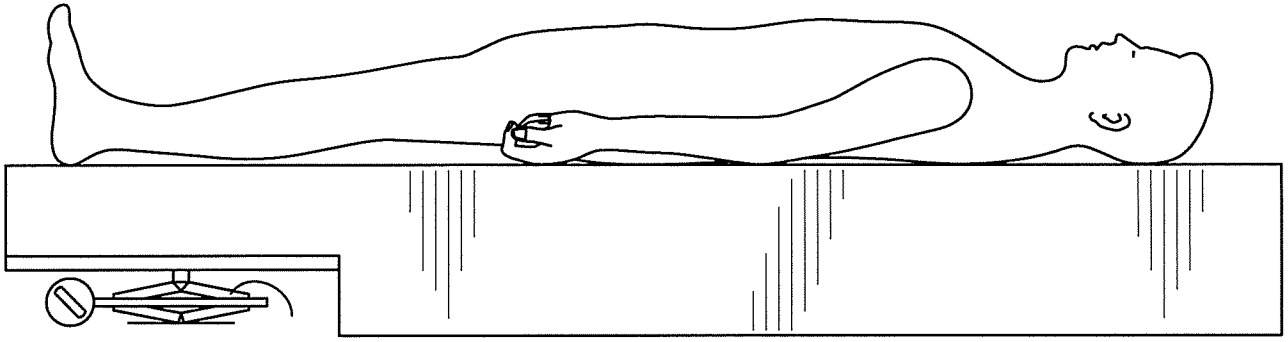
Figure 41:
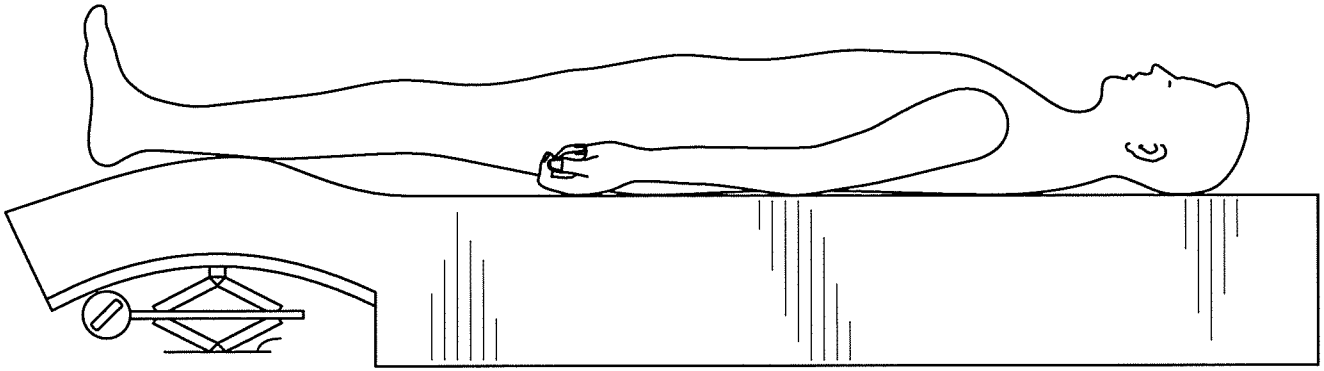

The adaptations by which the control system causes mattress heel region subsection 120 and occupant heel region 122 to temporarily disengage from each other and subsequently re-engage with each other can be expressed as a method of adjusting support for a person, such as a patient, as set forth below. At a time $t_0$ the patient is considered to be supported in a supine lying posture throughout substantially his entire height. The person is considered to be lying even if one or more of the mattress sections is at a nonhorizontal orientation, such as the orientations of sections 90, 94, 96 as seen in FIG. 1. The patient is considered to be supported throughout substantially his entire height even though his body shape causes certain parts of his body to not be in contact with the mattress. As seen in FIG. 19, examples of such body parts include the region 160 behind the patient's achilles tendon, popliteal region 162, arched portion 164 of his back, and arched region 166 behind his neck.

Figure 51:
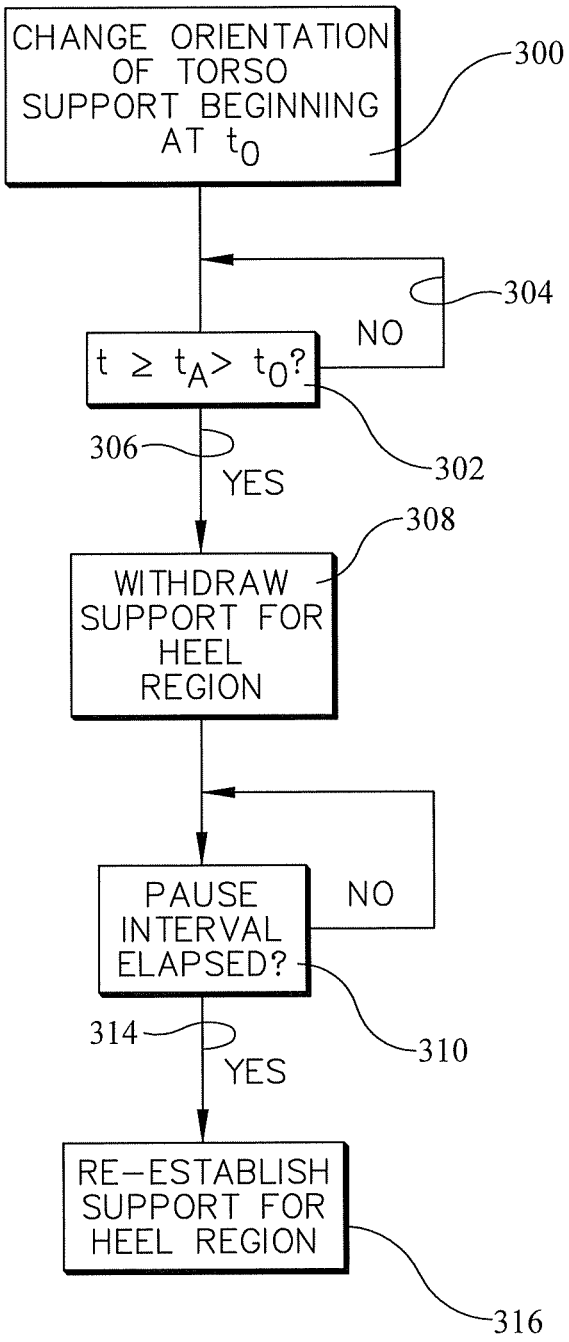
FIG. 51 is a block diagram showing a method of resisting skin injury to an occupant of an occupant support structure.

Referring to FIG. 51, at block 300 the method includes the step of changing the angular orientation of support for the person's torso. The orientation change begins at a time $t_0$. At block 302 the method establishes if at least $t_A$ units of time have elapsed since $t_0$. If not, the method follows "NO" path 304 from block 302 and continues to monitor the lapse of time. If so, the method follows "YES" path 306 to block 308 where the method carries out the step of withdrawing support for the person's heel region. The method then advances to block 310 where it pauses for an interval of time, for example the interval from $t_A$ to $t_B$ of FIG. 12. The time interval need be no longer than the time required for the patient's stretched skin to relax to its unstretched state. Once the time interval has elapsed the method follows "YES" path 314 to block 316. At block 316 the method re-establishes support for the patient's heel region.

Figure 52:
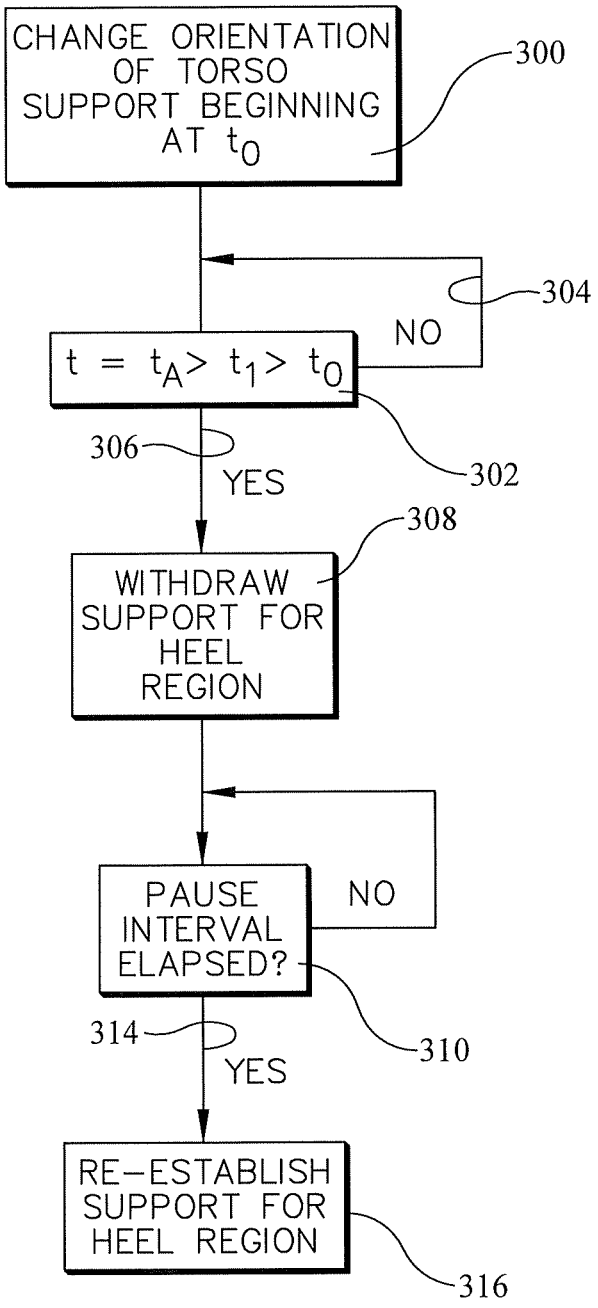
FIGS. 52-54 are block diagrams showing variations of the method of FIG. 51.

FIG. 52 is a block diagram the same as that of FIG. 51 except with a further constraint on the timing of the withdrawal of heel support at block 308. As seen at block 302 the additional constraint is that the withdrawal of support is deferred until at least time $t_1$, the time at which the orientation change of the torso section is complete. In other words the withdrawal of support begins no sooner than the time at which the torso section orientation change is complete.

Figure 53:
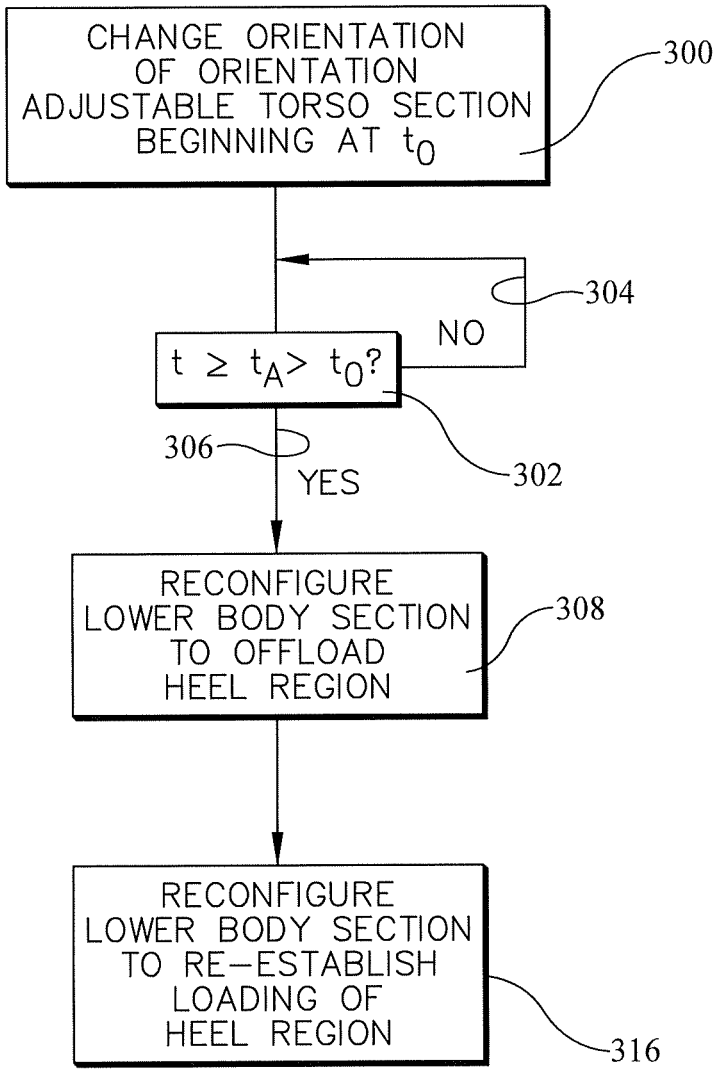

FIG. 53 is a block diagram similar to that of FIG. 51 except that 1) block 308 spells out that the method carries out a first reconfiguration of the lower body section in order to offload the heel region of the occupant, 2) block 316 spells out that the method carries out a second reconfiguration of the lower body section 98 to re-establish loading of the heel region, and 3) pause interval block 310 of FIG. 51 is absent. The pause interval is inherent in FIG. 53 because the re-establishment of heel loading at block 316 cannot occur until after the offloading has occurred at block 308.

Figure 54:
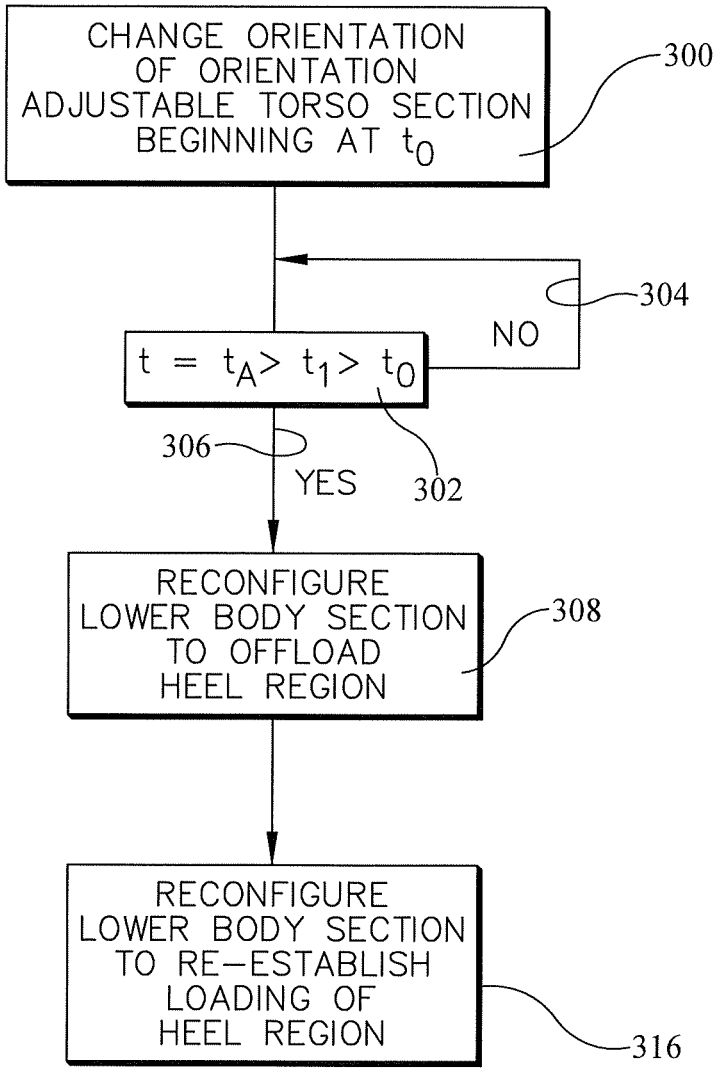

FIG. 54 is a block diagram that bears the same relationship to FIG. 53 as FIG. 52 bears to FIG. 51. That is, the reconfiguration of the lower body section to offload the heel region is deferred until at least time $t_1$, the time at which the orientation change of the torso section is complete.

As described above, the control system includes a processor and machine readable instructions which, when executed by the processor, cause the temporary disengagement and subsequent re-engagement of the occupant's heel section and the heel region subsection of the mattress. The described disengagement and re-engagement are automatically triggered in response to changes in torso section orientation. However the heel relief action can instead be carried out as an action which is not automatically triggered in response to a change in torso section orientation. For example the change in torso section orientation can be the result of a user pressing a first key on a keypad, and the heel relief action can be the result of the user pressing a second key on a keypad. Instructions 114 can be written to allow the orientation change and heel relief action to occur at least partly concurrently, or the heel relief action can be locked out during orientation change, even if the user presses the second button.

Although this disclosure refers to specific embodiments, it will be understood by those skilled in the art that various changes in form and detail may be made without departing from the subject matter set forth in the accompanying claims.

The invention claimed is:

1. An occupant support structure for supporting an occupant, the occupant support structure comprising:

an orientation adjustable torso section;

a lower body section including a heel region subsection adapted to support the heel region of an occupant of the occupant support; and a control system adapted to:

A) cause the heel region subsection to temporarily substantially disengage from the heel region of the occupant in response to a change of angular orientation of the torso section from a lowered position to a raised position, wherein the change of angular orientation of the torso section begins at a time $t_0$; and B) cause the heel region subsection to subsequently re-engage with the heel region of the occupant while the torso section remains stationary in the raised position, the re-engagement occurring at a time $t_B$ which is later than $t_0$, wherein the heel region subsection includes one or more bladders, the control system is adapted to:

a) begin inflating one of the bladders to effect the disengagement, b) during inflation of the bladder, compare actual internal pressure of the bladder to at least one limit; and c) if the actual pressure violates the limit, take corrective action.

2. The occupant support structure of claim 1 wherein the control system includes a processor and machine readable instructions which, when executed by the processor, cause the temporary disengagement and subsequent re-engagement.

3. The occupant support structure of claim 1 wherein the lower body section comprises a bladder array headwardly of the heel region subsection which is inflatable to effect the disengagement and deflatable to effect the re-engagement.

4. The occupant support structure of claim 3 wherein the bladder array comprises two or more longitudinally distributed bladders, and the control system is adapted to select a subset of the bladders and to inflate and deflate only the subset to effect the engagement and disengagement.

5. The occupant support structure of claim 4 wherein the subset is a single bladder.

6. The occupant support structure of claim 4 wherein the control system is adapted to command a test inflation of each of the bladders and to include in the selected subset whichever bladder the test inflation reveals to be most suitable to effect the engagement.

7. The occupant support structure of claim 3 wherein the bladder array comprises two or more longitudinally distributed bladders including a headwardmost bladder and a footwardmost bladder and the control system is adapted to inflate the bladders sequentially beginning with either the headwardmost bladder or the footwardmost bladder.

8. The occupant support structure of claim 6 wherein the bladders other than the selected bladder are deflated subsequent to the test inflation.

9. The occupant support structure of claim 6 wherein the test inflation is carried out concurrently for all the bladders.

10. The occupant support structure of claim 6 wherein the control system is adapted to include in the selected subset whichever bladder the test inflation reveals is most heavily loaded.

11. The occupant support structure of claim 1 wherein the torso section reaches a final orientation at a time $t_1$ and the disengagement occurs at a time $t_A$ which is no earlier than time $t_1$.

12. The occupant support structure of claim 1 wherein the lower body section comprises a bladder array longitudinally aligned with the heel region subsection which is deflatable to effect the disengagement and inflatable to effect the engagement.

13. The occupant support structure of claim 1 wherein the control system is adapted to cause the temporary substantial disengagement and the subsequent re-engagement only if the angular orientation of the torso section changes.

14. The occupant support structure of claim 13 wherein the control system is adapted to cause the temporary substantial disengagement and the subsequent re-engagement only if the angular orientation of the torso section changes away from horizontal.

15. The occupant support structure of claim 1 wherein:

A) the orientation adjustable torso section and the lower body section are mattress components; and B) the occupant support structure includes a frame having:

1) an orientation adjustable frame torso segment which supports and effects orientation adjustment of the orientation adjustable mattress torso section, and 2) a frame lower body segment which supports the mattress lower body section.

16. An occupant support structure for supporting an occupant, the occupant support structure comprising:

an orientation adjustable torso section;

a lower body section including a heel region subsection adapted to support the heel region of an occupant of the occupant support; and a control system adapted to:

A) cause the heel region subsection to temporarily substantially disengage from the heel region of the occupant in response to a change of angular orientation of the torso section from a lowered position to a raised position, wherein the change of angular orientation of the torso section begins at a time $t_0$; and B) cause the heel region subsection to subsequently re-engage with the heel region of the occupant while the torso section remains stationary in the raised position, the re-engagement occurring at a time $t_B$ which is later than $t_0$, wherein the lower body section comprises a bladder array headwardly of the heel region subsection which is inflatable to effect the disengagement and deflatable to effect the re-engagement, wherein the bladder array comprises two or more longitudinally distributed bladders including a headwardmost bladder and a footwardmost bladder and the control system is adapted to inflate the bladders sequentially beginning with either the headwardmost bladder or the footwardmost bladder.

17. The occupant support structure of claim 16 wherein the control system is adapted to cause the temporary substantial disengagement and the subsequent re-engagement only if the angular orientation of the torso section changes.

18. The occupant support structure of claim 17 wherein the control system is adapted to cause the temporary substantial disengagement and the subsequent re-engagement only if the angular orientation of the torso section changes away from horizontal.

19. An occupant support structure for supporting an occupant, the occupant support structure comprising:

an orientation adjustable torso section;

a lower body section including a heel region subsection adapted to support the heel region of an occupant of the occupant support; and a control system adapted to:

A) cause the heel region subsection to temporarily substantially disengage from the heel region of the occupant in response to a change of angular orientation of the torso section from a lowered position to a raised position, wherein the change of angular orientation of the torso section begins at a time $t_0$; and B) cause the heel region subsection to subsequently re-engage with the heel region of the occupant while the torso section remains stationary in the raised position, the re-engagement occurring at a time $t_B$ which is later than $t_0$, wherein the lower body section comprises a bladder array headwardly of the heel region subsection which is inflatable to effect the disengagement and deflatable to effect the re-engagement, wherein the bladder array comprises two or more longitudinally distributed bladders, and the control system is adapted to select a subset of the bladders and to inflate and deflate only the subset to effect the engagement and disengagement, wherein the control system is adapted to command a test inflation of each of the bladders and to include in the selected subset whichever bladder the test inflation reveals to be most suitable to effect the engagement, wherein the control system is adapted to include in the selected subset whichever bladder the test inflation reveals is most heavily loaded.

20. The occupant support structure of claim 19 wherein the control system is adapted to cause the temporary substantial disengagement and the subsequent re-engagement only if the angular orientation of the torso section changes.

21. The occupant support structure of claim 20 wherein the control system is adapted to cause the temporary substantial disengagement and the subsequent re-engagement only if the angular orientation of the torso section changes away from horizontal.

* * * * *